US007489881B2

(12) United States Patent
Yasukawa et al.

(10) Patent No.: US 7,489,881 B2
(45) Date of Patent: Feb. 10, 2009

(54) FAILURE PREVENTION DIAGNOSIS SUPPORT SYSTEM, FAILURE PREVENTION DIAGNOSIS SUPPORT METHOD, AND PROGRAM PRODUCT OF FAILURE PREVENTION DIAGNOSIS SUPPORT

(75) Inventors: Kaoru Yasukawa, Kanagawa (JP); Koji Adachi, Kanagawa (JP); Koki Uwatoko, Kanagawa (JP); Tetsuichi Satonaga, Kanagawa (JP); Norikazu Yamada, Kanagawa (JP); Eigo Nakagawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 175 days.

(21) Appl. No.: 11/646,254

(22) Filed: Dec. 28, 2006

(65) Prior Publication Data

US 2007/0280706 A1 Dec. 6, 2007

(30) Foreign Application Priority Data

Jun. 2, 2006 (JP) ..... 2006-154132

(51) Int. Cl.
*G03G 15/00* (2006.01)

(52) U.S. Cl. ..... 399/8; 399/9

(58) Field of Classification Search ..... 399/8, 399/9, 38; 358/1.15, 504, 406; 347/19; 702/183, 702/181, 81
See application file for complete search history.

(56) References Cited

U.S. PATENT DOCUMENTS

2005/0002054 A1* 1/2005 Shoji et al. ..... 399/9 X
2005/0240376 A1* 10/2005 Uwatoko et al. ..... 702/183
2008/0002995 A1* 1/2008 Kamisuwa et al. ..... 399/8

FOREIGN PATENT DOCUMENTS

JP 08-030152 A 2/1996
JP 2005-017874 A 1/2005

* cited by examiner

*Primary Examiner*—Sophia S Chen
(74) *Attorney, Agent, or Firm*—Oliff & Berridge PLC

(57) ABSTRACT

A failure prevention diagnosis support system includes: an acquiring portion that acquires internal information about an internal state of an image forming apparatus; a storage portion that stores one or a plurality of logistic regression models that define an estimate value of a regression coefficient through a logistic regression analysis using the internal information obtained when the image forming apparatus is in a failed state and in a normal state; and a controller that performs a control operation to select a logistic regression model from the one or the plurality of the logistic regression models stored in the storage portion in accordance with the image forming apparatus, and to calculate risk degrees as objective variables that are indicators of failure degrees in the image forming apparatus by assigning the internal information acquired by the acquiring portion or the value obtained from the internal information to the selected logistic regression model.

19 Claims, 26 Drawing Sheets

FIG. 3

TH CHRONOLOGICAL INFORMATION TABLE

| DATA COLLECTING DATE | MACHINE NUMBER | INTERNAL INFORMATION | | | | | ... | INTERNAL INFORMATION | | | | | | ... |
|---|---|---|---|---|---|---|---|---|---|---|---|---|---|---|
| | | SYSTEM FAILURE NUMBER | IMAGE-QUALITY LOCAL FAILURE NUMBER | IMAGE-QUALITY SENSOR MEASUREMENT VALUE | OPERATION ERROR INTERVAL AVERAGE FED SHEET NUMBER | IMAGE-QUALITY CRITICAL RATE | ... | PAPER JAM NUMBER | DOCUMENT PAPER JAM NUMBER | PAPER JAM INTERVAL AVERAGE FED SHEET NUMBER | PAPER LOCAL FAILURE NUMBER | PAPER-FEED CRITICAL RATE | TOTAL FED PAPER SHEET NUMBER | ... |
| 2006/8/11 | 711345 | 1 | 1 | 100 | 8000 | 20% | ... | 0 | 0 | 5000 | 0 | 18% | 10000 | ... |
| 2006/8/11 | 711346 | 1 | 1 | 50 | 400 | 10% | ... | 0 | 0 | 1000 | 0 | 11% | 1000 | ... |
| 2006/8/12 | 711345 | 1 | 0 | 95 | 8510 | 21% | ... | 1 | 0 | 5100 | 1 | 19% | 11200 | ... |
| ⋮ | ⋮ | ⋮ | ⋮ | ⋮ | ⋮ | ⋮ | | ⋮ | ⋮ | ⋮ | ⋮ | ⋮ | ⋮ | |

| INTERNAL INFORMATION | | | | | | ... | INTERNAL INFORMATION | | | | | | ... |
|---|---|---|---|---|---|---|---|---|---|---|---|---|---|
| JAM FAILURE INFORMATION | | | | | | ... | NON-JAM-TRIGGERING FAILURE INFORMATION | | | | | | ... |
| JAM FAILURES PER COMPONENT | | JAM-TRIGGERING ERROR NUMBER | | | | ... | NON-JAM-TRIGGERING ERROR NUMBER | | | | | | ... |
| Fuser_Jam | Regi_Jam | SensorC_Fail | Soft_Fail | USB_Ope | Communication Fail | ... | ESS_Fan Fail | IOT_Logic Fail | SensorC_Fail | Soft Fail | USB_Open_Fail | Communication Fail | ... |
| 0 | 0 | 0 | 0 | 0 | 0 | ... | 0 | 0 | 0 | 0 | 0 | 0 | ... |
| 0 | 0 | 0 | 0 | 0 | 0 | ... | 0 | 0 | 0 | 0 | 0 | 0 | ... |
| 1 | 0 | 0 | 0 | 0 | 0 | ... | 1 | 0 | 0 | 0 | 0 | 0 | ... |
| ⋮ | ⋮ | ⋮ | ⋮ | ⋮ | ⋮ | | ⋮ | ⋮ | ⋮ | ⋮ | ⋮ | ⋮ | |

| INTERNAL INFO | | IMAGE-QUALITY DEGRADATION RISK | PAPER-FEED TROUBLE RISK | TOTAL RISK |
|---|---|---|---|---|
| PROGRESS INFO | | | | |
| ELAPSED TIME | IMAGE FORMATION NUMBER | | | |
| 120 | 9000 | 0.07 | 0.03 | 0.1 |
| 10 | 500 | 0.4 | 0.1 | 0.5 |
| 145 | 1200 | 0.06 | 0.02 | 0.08 |
| ⋮ | ⋮ | ⋮ | ⋮ | ⋮ |

FIG. 4

TMT MACHINE SERVICE TABLE

| MACHINE NO | SERVICE ENGINEER SE CODE | TERRITORY CODE | MACHINE MODEL CODE |
|---|---|---|---|
| 711345 | 12345 | 921210021 | F120MF |
| 711346 | 12345 | 921210021 | F120MF |
| 711347 | 12345 | 921210021 | F120MF |
| 711348 | 12345 | 921210021 | F120MF |
| 711349 | 12345 | 921210021 | F120MF |
| 711350 | 12345 | 921210022 | F120MF |
| 711351 | 12345 | 921210022 | F120MF |
| 711352 | 12345 | 921210022 | F120MF |
| 711353 | 12345 | 921210022 | F120MF |
| 711354 | 12345 | 921210022 | F120MF |
| ⋮ | ⋮ | ⋮ | ⋮ |
| 800001 | 12346 | 921220000 | F125MF |
| 800002 | 12346 | 921220000 | F125MF |
| 800003 | 12346 | 921220000 | F125MF |
| 800004 | 12346 | 921220000 | F125MF |
| 800005 | 12346 | 921220000 | F125MF |
| ⋮ | ⋮ | ⋮ | ⋮ |

FIG. 5
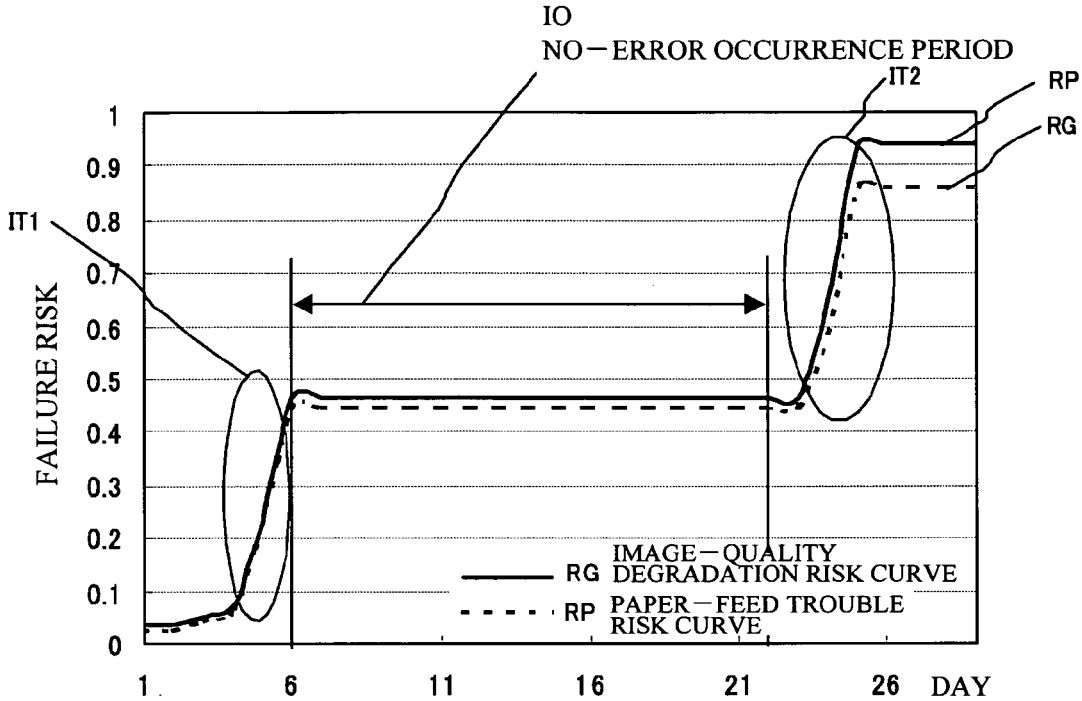
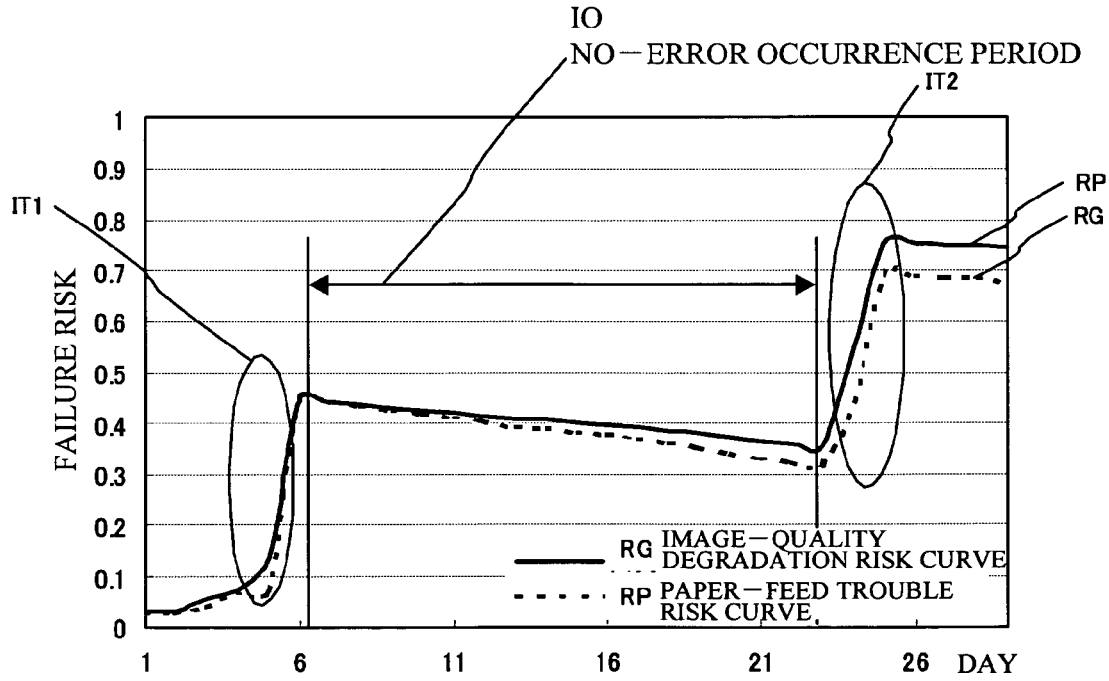
IT1 FIRST ERROR OCCURRENCE PERIOD
IT2 SECOND ERROR OCCURRENCE PERIOD

FIG. 6

TI INTERNAL INFORMATION TABLE

| NON-JAM FAILURE INFO | JAM FAILURE INFO |
|---|---|
| ESS_FanFail | Fuser_Jam |
| IOT_LogicFail | Regi_Jam |
| SensorC_Fail | SensorC_Fail |
| SoftFail | SoftFail |
| USB_Open_Fail | USB_Open_Fail |
| CommunicationFail | CommunicationFail |

TF FAILURE INFORMATION WEIGHTING TABLE

| NON-JAM FAILURE INFO | EFFECT | WEIGHTING VARIABLE |
|---|---|---|
| ESS_FanFail | LARGE | $\alpha$ |
| IOT_LogicFail | | |
| SensorC_Fail | MEDIUM | $\beta$ |
| SoftFail | | |
| USB_Open_Fail | SMALL | $\gamma$ |
| CommunicationFail | | |

$(\alpha > \beta > \gamma)$

TJ JAM INFORMATION WEIGHTING TABLE

| JAM FAILURE INFO | EFFECT | WEIGHTING VARIABLE |
|---|---|---|
| Fuser_Jam | LARGE | $\delta$ |
| Regi_Jam | | |
| SensorC_Fail | MEDIUM | $\varepsilon$ |
| SoftFail | | |
| USB_Open_Fail | SMALL | $\zeta$ |
| CommunicationFail | | |

$(\delta > \varepsilon > \zeta)$

ACO1 FIRST CODE DISPLAY REGION

AR FAILURE RISK DISPLAY REGION

BTF PREVIOUS LIST DISPLAY BUTTON

BTB LATER LIST DISPLAY BUTTON

BTM01～10 DETAILED INFORMATION DISPLAY SCREEN

ACO2 SECOND CODE DISPLAY REGION

AG CHART DISPLAY REGION

R RISK CURVE

RP PAPER−FEED TROUBLE RISK CURVE

RG IMAGE−QUALITY DEGRADATION RISK CURVE

ACO3 THIRD CODE DISPLAY REGION

ARP COMPONENT FAILURE PROBABILITY DISPLAY REGION

FAILURE PREVENTION DIAGNOSIS SUPPORT SYSTEM, FAILURE PREVENTION DIAGNOSIS SUPPORT METHOD, AND PROGRAM PRODUCT OF FAILURE PREVENTION DIAGNOSIS SUPPORT

BACKGROUND

1. Technical Field

The present invention generally relates to a failure prevention diagnosis system and a failure prevention diagnosis method for facilitating a decision on whether measures against failure are needed on the basis of a diagnosis of an image forming apparatus, and more particularly, to a failure prevention diagnosis system and a failure prevention diagnosis method for facilitating a highly precise and efficient decision on the basis of standardized criteria.

2. Related Art

To prevent failures in image forming apparatuses, service engineers collect the information about errors that can be caused in image forming apparatuses via a network or the like, and determines whether to take measures against failure or to make repairs for each image forming apparatus, based on the collected information.

However, it is not necessary to promptly correct an error in an image forming apparatus, if the error is fortuitously caused. Also, image forming apparatuses for different purposes have different criteria in determining which errors require urgent repair.

Therefore, there is a need for devices that can efficiently determine whether measures against failure should be taken.

There have been already known a state determining device and a remote failure diagnosis system. However, a larger number of threshold values needs to be set, maintained, and managed in each state determining device. This leads to an increase in workload, and in addition, failures cannot be diagnosed with constantly high precision.

SUMMARY

An aspect of the present invention provides a failure prevention diagnosis support system including: an acquiring portion that acquires internal information about an internal state of an image forming apparatus; a storage portion that stores one or a plurality of logistic regression models that define an estimate value of a regression coefficient through a logistic regression analysis using the internal information obtained when the image forming apparatus is in a failed state and in a normal state, the one or the plurality of logistic regression models having an objective variable that is a binary variable representing one of a failed state and a normal state of the image forming apparatus, the one or the plurality of logistic regression models having an explanatory variable that is the internal information about the image forming apparatus or a value obtained from the internal information; and a controller that performs a control operation to select a logistic regression model from the one or the plurality of the logistic regression models stored in the storage portion in accordance with the image forming apparatus, and to calculate risk degrees as objective variables that are indicators of failure degrees in the image forming apparatus by assigning the internal information acquired by the acquiring portion or the value obtained from the internal information to the selected logistic regression model.

BRIEF DESCRIPTION OF THE DRAWINGS

Embodiments of the present invention will be described in detail based on the following figures, wherein:

FIG. 3 shows an example of chronological information to be stored in the memory;

FIG. 4 shows an example of a table that is stored in the memory and shows the correlation between the image forming apparatus identification information and the placement area identification information;

FIG. 5 shows an example of an effect of the time-course information on the risk degrees;

FIG. 6 shows the relationship between the internal information and the weighting coefficients;

DETAILED DESCRIPTION

Figure 1:
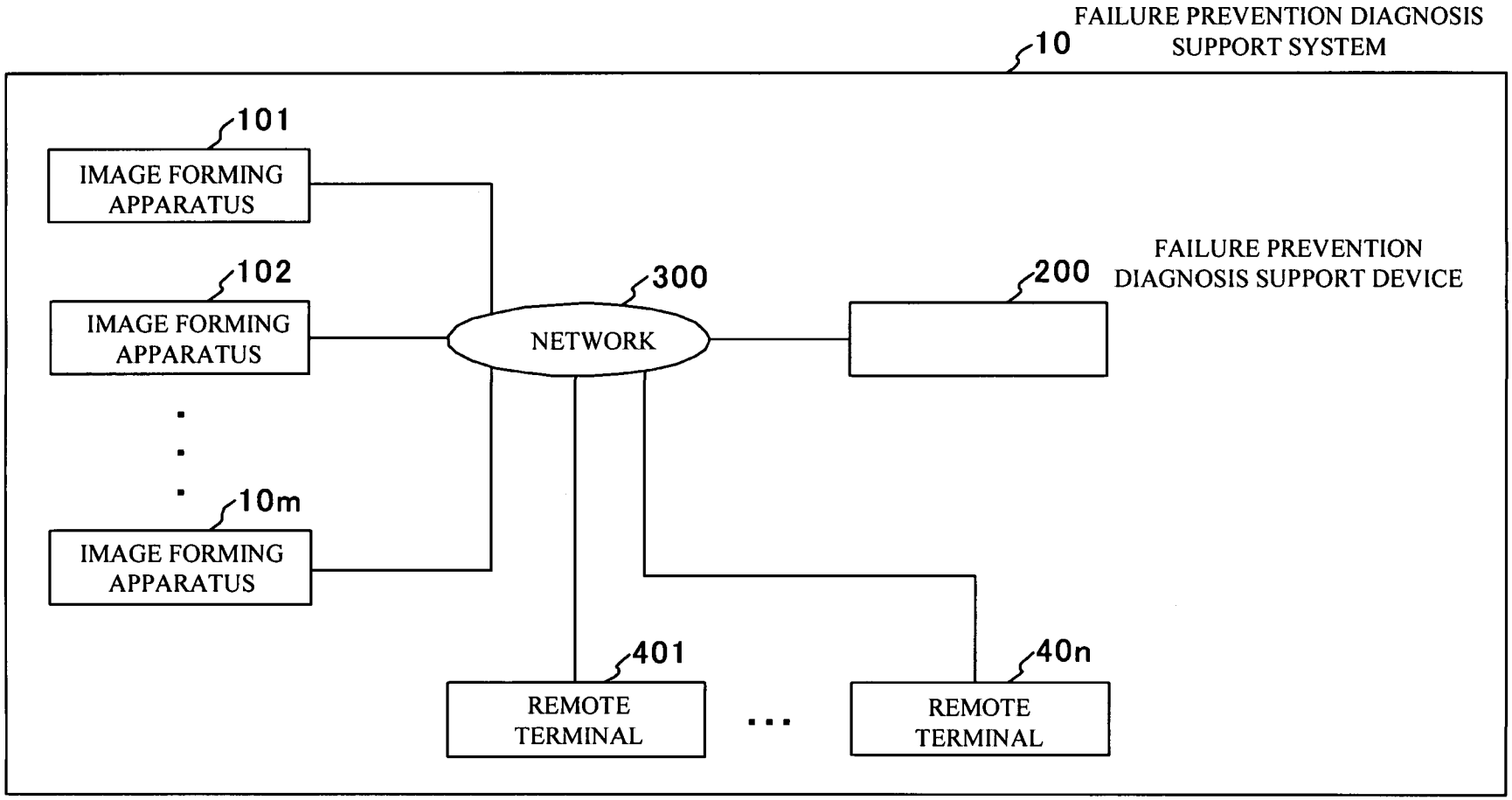
FIG. 1 illustrates an example structure of a failure prevention diagnosis support system in accordance with the present invention.

The following is a description of exemplary embodiments of the present invention, with reference to the accompanying drawings. FIG. 1 illustrates an example structure of a failure prevention diagnosis support system 10 in accordance with the present invention.

The failure prevention diagnosis support system 10 includes one or more image forming apparatuses 101 through 10m, a failure prevention diagnosis support device 200, and remote terminals 401 through 40n as terminal devices. The image forming apparatuses 101 through 10m, the failure prevention diagnosis support device 200, and the remote terminals 401 through 40n are communicably connected to one another via a network 300.

The image forming apparatuses 101 through 10m are formed with complex machines having functions such as a printer function, a facsimile function, and a copier function. The image forming apparatuses 101 through 10m transmit image forming apparatus identification information that is the information for identifying the image forming apparatuses 101 through 10m, internal information that is the information relating to the inner states of the image forming apparatuses 101 through 10m, acquirement time information that represents the time at which the internal information is acquired, and environment information that is the information relating to the operational environments of the image forming apparatuses 101 through 10m, to the failure prevention diagnosis support device 200, with those pieces of information being associated with one another. The internal information will be described later in detail.

The failure prevention diagnosis support device 200 may be formed with a personal computer or a server device, for example. The failure prevention diagnosis support device 200 acquires the image forming apparatus identification information, the internal information, the acquirement time information, and the environment information from the image forming apparatuses 101 through 10m, with those pieces of information being associated with one another.

Although not shown in the drawings, the failure prevention diagnosis support device 200 also acquires information that is input by input portions provided as the input means in the remote terminals 401 through 40n. Further, the failure prevention diagnosis support device 200 transmits information to be displayed on displays provided as the display means in the remote terminals 401 through 40n, and information for controlling the remote terminals 401 through 40n, though not shown in the drawings. The failure prevention diagnosis support device 200 transmits those pieces of information to the remote terminals 401 through 40n. The information that is input by the input portions provided in the remote terminals 401 through 40n and the information to be displayed on the displays are the same as the later described information that is input by an input portion 205 provided in the failure prevention diagnosis support device 200 and the later described information to be displayed on a display 204.

Figure 2:
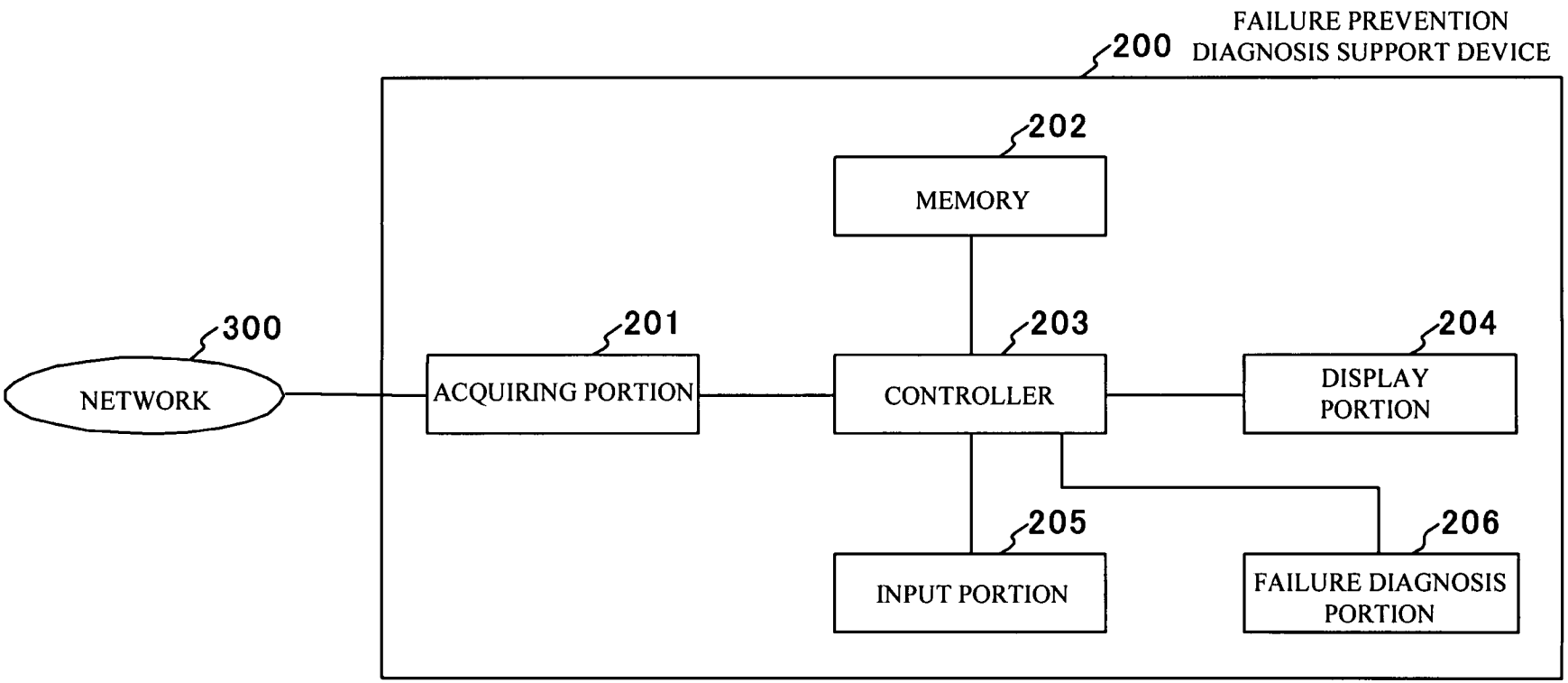
FIG. 2 illustrates an example structure of a failure prevention diagnosis support device.

Referring now to FIG. 2, an example structure of the failure prevention diagnosis support device 200 is described. FIG. 2 illustrates the example structure of the failure prevention diagnosis support device 200.

The failure prevention diagnosis support device 200 includes an acquiring portion 201 as the acquiring means, a memory 202 as the memory means, a controller 203 as the control means, the display 204 as the display means, the input portion 205 as the input means, and a failure diagnosis portion 206.

The acquiring portion 201 may be formed with a network card, for example. The acquiring portion 201 is connected to the controller 203 and the network 300. The acquiring portion 201 acquires the internal information, the environment information, the acquirement time information, and the image forming apparatus identification information transmitted from the image forming apparatuses 101 through 10m via the network 300, with those pieces of information being associated with one another. The acquiring portion 201 then transmits the internal information, the environment information, the acquirement time information, the image forming apparatus identification information, and the likes, to the controller 203.

With this structure, the internal information of the image forming apparatuses can be acquired through the network, and accordingly, the image forming apparatuses can be managed and supported in an integrated fashion.

The memory 202 stores the internal information, the environment information, the acquirement time information, the image forming apparatus identification information, and the likes, which are acquired by the acquiring portion 201. Those pieces of information are associated with one another. The memory 202 stores the internal information acquired from the image forming apparatuses 101 through 10m in chronological order.

Referring now to FIG. 3, the internal information to be stored in the memory 202 is described. FIG. 3 shows an example of the chronological information to be stored in the memory 202.

The memory 202 has a chronological information table TH. In the chronological information table TH, the internal information, the environment information, the acquirement time information, and the image forming apparatus identification information, which are acquired by the acquiring portion 201 and are associated with one another, are stored on the same record by the controller 203, so as to maintain those pieces of information associated with one another. More specifically, the acquirement time information and the image forming apparatus identification information are stored in a data collection date column and a machine number column. In the chronological information table TH, no two records have the same acquirement time information or the same image forming apparatus identification information.

In the chronological information table TH, an image-quality degradation risk, a paper-feed trouble risk, and a total risk that are calculated by the controller 203 based on the internal information associated with the acquirement time information and the image forming apparatus identification information acquired by the acquiring portion 201 are stored on the same record as the internal information used for the calculation. In this manner, those pieces of risk information are associated with the internal information.

The image-quality degradation risk, the paper-feed trouble risk, and the total risk are stored in an image-quality degradation risk column, a paper-feed trouble risk column, and a total risk column of the chronological information table TH. The image-quality degradation risk, the paper-feed trouble risk, and the total risk will be described later in detail.

The environment information is information that is acquired through sensors provided in the image forming apparatuses 101 through 10m or information that is set in the image forming apparatuses 101 through 10m. The column in which the environment information is to be stored is not shown in the chronological information table TH in FIG. 3.

The internal information contains the number of system failures, the number of image-quality local failures, image-quality sensor measurement values, the average number of paper sheets fed between two operation errors, and the image-quality critical rate. Under the control of the controller 203, those pieces of internal information is stored in a system failure number column, an image-quality local failure number column, an image-quality sensor measurement value column, an error-interval average fed sheet number column, and an image-quality critical rate column.

The number of system failures indicates the number of times an operation error has occurred in the image forming apparatuses 101 through 10m identified by the image forming apparatus identification information stored in the machine number column. The number of image-quality local failures indicates the number of outputs of image quality sensors that exceed a predetermined range. The image-quality critical rate indicates the value that is determined by dividing the number of uses of expendable articles at present by the largest possible number of uses of the expendable items that affect the image quality.

Specific examples of the expendable items that affect the image quality include a drum and a developer. The image quality sensors detect the information relating to the image quality of the image forming apparatuses 101 through 10m. More specifically, the image quality sensors are color density sensors that detects the density of cyan, magenta, yellow, or black in each image that is output in the image forming apparatuses 101 through 10m. Especially, the color density sensor that detects the density of cyan is called "sensor C".

The internal information also contains the number of times a paper jam has occurred, the number of times a document paper jam has occurred, the average number of paper sheets fed between two paper jams, the number of paper local failures, the total number of paper sheets that have been fed, and the paper-feed critical rate. Those pieces of information are stored in a paper jam occurrence number column, a document paper jam occurrence number column, a paper-jam-interval average fed paper sheet number column, a paper local failure number column, a total fed paper sheet number column, and a paper-feed critical rate column.

The paper local failure number indicates the number of times the outputs of paper sheet sensors exceed a predetermined value range. The paper-feed critical rate indicates the value that is determined by dividing the number of uses of expendable items at present by the largest possible number of uses of the expendable items that are used for feeding paper sheets. The paper sensors detect the information relating to paper sheets in the image forming apparatuses 101 through 10m. Specific examples of the expendable items that are used for feeding paper sheets include a roller, a solenoid, and a motor.

The internal information further contains jam failure information and non-jam failure information.

The jam failure information relates to operation errors that are paper jams. The non-jam failure information relates to operation errors that are not paper jams.

The jam failure information contains the number of jams per component and the numbers of jam-triggering errors. The non-jam failure information contains the numbers of non-jam-triggering errors.

The number of jams per component indicates the number of times a paper jam has occurred in the components forming the image forming apparatuses 101 through 10m. More specifically, the number of jams per component indicates the number of times a paper jam has occurred at the fuser roller and the registration roller that are used for feeding paper sheets. The number of times a paper jam has occurred at the fuser roller and the registration roller is stored in a fuser jam column and a registration jam column.

The numbers of jam-triggering errors indicates the numbers of errors caused in the components forming the image forming apparatuses 101 through 10m due to factors that have caused operation errors that are paper jams.

More specifically, the numbers of jam-triggering errors contains information such as the number of jam-triggering sensor-C failures, the number of jam-triggering software failures, the number of jam-triggering USB opening failures, and the number of jam-triggering communication failures.

The number of jam-triggering sensor-C failures indicates the number of times a paper jam has been detected based on the measurement value of the sensor C. The number of jam-triggering software failures indicates the number of times a paper jam has occurred due to a software error. The number of jam-triggering USB opening failures indicates the number of times a paper jam has occurred due to a failure in opening a USB port. The number of jam-triggering communication failures indicates the number of times a paper jam has occurred due to a communication failure.

A communication failure is a failure in communication due to a data exchange error or a timing error between two boards such as an image input terminal board and an image output terminal board.

The number of jam-triggering communication failures, the number of jam-triggering sensor-C failures, the number of jam-triggering software failures, and the number of jam-triggering USB opening failures are stored in a communication failure column, a sensor-C failure column, a software failure column, and a USB opening failure column that are the columns for storing the numbers of jam-triggering errors.

The numbers of non-jam-triggering errors indicates the numbers of errors caused in the components forming the image forming apparatuses 101 through 10m due to factors that have caused operation errors that are not paper jams.

More specifically, the numbers of non-jam-triggering errors contains information such as the number of non-jam-triggering ESS fan failures, the number of non-jam-triggering IOT logic failures, the number of non-jam-triggering sensor-C failures, the number of non-jam-triggering software failures, the number of non-jam-triggering USB opening failures, and the number of non-jam-triggering communication failures.

The number of non-jam-triggering ESS fan failures indicates the number of times an operation error that is not a paper jam has occurred where an error in the ESS-related components has supposedly occurred due to an error in the fan provided in the ESS (electric SubSystem) that is the central part of the circuit. The number of non-jam-triggering IOT logic failures indicates the number of times an operation error that is not a paper jam has occurred due to a logic error in the IOT. The number of non-jam-triggering sensor-C failures indicates the number of times an operation error that is not a paper jam has been detected based on the measurement value of the sensor C. The number of non-jam-triggering software failures indicates the number of times an operation error that is not a paper jam has occurred due to a software error. The number of non-jam-triggering USB opening failures indicates the number of times an operation error that is not a paper jam has occurred due to a failure in opening a USB port. The number of non-jam-triggering communication failures indicates the number of times an operation error that is not a paper jam has occurred due to a communication failure.

The number of non-jam-triggering ESS fan failures, the number of non-jam-triggering IOT logic failures, the number of non-jam-triggering sensor-C failures, the number of non-jam-triggering software failures, and the number of non-jam-triggering USB opening failures are stored in an ESS fan failure column, an IOT logic failure column, a sensor-C failure column, a software failure column, and a USB opening failures column that are columns for storing the numbers of non-jam-triggering failures.

The internal information further contains time-course information. The time-course information represents the time course of the image forming apparatuses 101 through 10m between a repair time and a support time. More specifically, the time-course information contains the elapsed time between a repair and a support of the image forming apparatuses 101 through 10m, and an image formation number that indicates the number of times an image has been formed.

The elapsed time and the image formation number are stored in an elapsed time column and an image formation number column.

In a case where a service engineer in charge of the image forming apparatuses 101 through 10m has confirmed a failure, the image forming apparatuses 101 through 10m transmit a failure flag that is the information indicating the confirmation of the failure, together with the internal information and the acquirement time at the time of the failure, to the failure prevention diagnosis support device 200 through an operation by the service engineer. Further, failure type information indicating that the type of the failure is an image-quality failure that adversely affects the image quality or a paper-feed failure that adversely affects the paper feed or some other failure is transmitted together with the internal information. The acquiring portion 201 of the failure prevention diagnosis support device 200 then receives the internal information, the failure flag, the failure type information, and the acquirement time, which are associated with one another.

The chronological information table TH of the memory 202 then stores the internal information, the failure flag, the failure type information, and the acquirement time, which are associated with one another, under the control of the controller 203. The column for storing the failure flag and the failure type information are not shown in the drawing.

When the service engineer finishes the maintenance, the image forming apparatuses 101 through 10m transmit an end flag indicating that the maintenance has finished, together with the internal information and the acquirement time at the time of the end of the maintenance, to the failure prevention diagnosis support device 200. The acquiring portion 201 of the failure prevention diagnosis support device 200 then receives the internal information and the maintenance end flag that are associated with each other.

The chronological information table TH of the memory 202 then stores the internal information and the maintenance end flag that are associated with each other, under the control of the controller 203. The column for storing the maintenance end flag is not shown in the drawing.

The acquirement time associated with the failure flag is referred to as a prevention maintenance start date STM, and the acquirement time associated with the maintenance end flag is referred to as a failure prevention maintenance end date ETM.

The memory 202 further stores placement area identification information and service-engineer identification information relating to the image forming apparatuses 101 through 10m identified by the image forming apparatus identification information associated with the placement area identification information and the service engineer identification information, under the control of the control means. The placement area identification information is the information that identifies the placement area of the image forming apparatuses 101 through 10m. The service engineer identification information is the information that identifies the service engineer in charge of the image forming apparatuses 101 through 10m.

Referring now to FIG. 4, the correlation between the image forming apparatus identification information and the placement area identification information stored in the memory 202 is described. FIG. 4 shows an example of the table showing the correlation between the image forming apparatus identification information and the placement area identification information.

As shown in FIG. 4, the memory 202 has a machine service table TMT. In the machine service table TMT, the image forming apparatus identification information, the service engineer identification information that identifies the person in charge of the maintenance of the image forming apparatuses 101 through 10m identified by the image forming apparatus identification information, the placement area identification information, and the machine model identification information that identifies the model of the image forming apparatuses 101 through 10m are stored on the same record, with those pieces of information being associated with one another.

The machine service table TMT has a machine number column, a service engineer code column (hereinafter referred to simple as the service engineer SE code column), a territory code column, and a machine model code column.

Machine numbers that are the image forming apparatus identification information are stored in the machine number column. SE codes that are the service engineer identification information are stored in the SE code column. Territory codes that are the placement area identification information are stored in the territory code column. Machine model codes that are the machine model identification information are stored in the machine model code column.

The memory 202 further stores one or more logistic regression models. A logistic regression model in the present invention has a binary variable as an objective variable that alternatively represents a failed state or a normal state of the image forming apparatuses 101 through 10m, and an explanatory variable that is the internal information or a value obtained from the internal information of the image forming apparatuses 101 through 10m. A logistic regression model in the present invention also defines an estimate value of a regression coefficient by carrying out a logistic regression analysis using the internal information obtained in a failed state and in a normal state of the image forming apparatuses 101 through 10m. The value obtained from the internal information will be described later.

A logistic regression model stored in the memory 202 of the present invention is selected at the time of support by the controller 203 in accordance with the image forming apparatuses 101 through 10m to be supported. The internal information acquired by the acquiring portion 201 or the value obtained from the internal information is assigned to the explanatory variable in the selected logistic regression model to be used for calculating the degree of risk. The degree of risk is an indicator of the degree of a failure in the image forming apparatus.

In this exemplary embodiment, the logistic regression models include both an image-quality logistic regression model that is a model for calculating the image-quality degradation risk as an indicator of the degree of a failure that causes degradation of the image quality, and a paper-feed logistic regression model that is a model for calculating the paper-feed trouble risk as an indicator of the degree of a failure that causes a paper jam. In this exemplary embodiment, a total logistic regression model is also used as a model for calculating the total trouble risk as an indicator of the degree of all failures that occur in the image forming apparatus.

In general, paper jam occurrences often depend on the humidity in the use environment or the state of the used paper sheet, and most paper jams fortuitously occur. On the other hand, image-quality errors tend to repeatedly appear, except for operation errors that are fortuitously caused due to noise. This is because an image-quality error is caused by a failure in a component or an operation error in a component.

With the structure of this exemplary embodiment, the indicators of failures that have different properties and are caused by different factors are calculated with the use of different models. Accordingly, the risks can be calculated more accurately than in a case where the risk of a failure that causes an image-quality error and the risk of a failure that causes a paper jam are calculated with the use of the same model.

First, a first example of the image-quality logistic regression model of the present invention is described. The first example of the image-quality logistic regression model is expressed by the following equations (1):

$$F_{g1}(Z_{g1}) = \frac{1}{1+\exp(-Z_{g1})} \tag{1}$$

$$Z_{g1} = \sum_{i=0}^{4} \beta_{g1i} X_{g1i}$$

$F_{g1}(Z_{g1})$: objective variable
$\beta_{g1i}$: regression coefficient
$X_{g1i}$: explanatory variable
$F_{g1}(Z_{g1})$: image-quality degradation risk
$X_{g10}$: total number of system failures
$X_{g11}$: total number of image-quality local failures
$X_{g12}$: image-quality sensor measurement value
$X_{g13}$: average number of operation-error-interval fed sheets
$X_{g14}$: image-quality critical rate The average number of operation-error-interval fed sheets is the average number of paper sheets that are fed between two operation errors.

In each of the following examples of the image-quality logistic regression model of the present invention, the objective variable is "0" in a normal state and "1" in a failed state. A logistic regression analysis is carried out with the use of observed values that are the internal information acquired in a failed state that causes degradation of the image quality and in a normal state. In this manner, an estimate value of the regression coefficient is determined.

With this structure, the objective variable becomes a binary variable that is "0" in a normal state and "1" in a failed state. Accordingly, the degree of risk that is a value estimated by the logistic regression model becomes equal to the value obtained by dividing the difference between the risk value and the normal-state value by the absolute value of the difference between the normal-state value and the failed-state value.

In general, a failure that adversely affects the image quality is regarded as an error in the entire system, and is detected based on the value of the image-quality sensor. As the number of paper sheets fed between two failures decreases, failures occur more frequently. Also, as the paper-feed critical rate becomes higher, the failure probability becomes higher.

With this structure, the explanatory variable of the image-quality logistic regression model includes at least one variable among the number of system failures, the number of image-quality local failures, the image-quality sensor measurement value, the average number of paper sheets fed between two failures, and the image-quality critical rate. Accordingly, the degree of risk can be calculated more accurately than in a case where an image-quality logistic regression model not having any of the variables as the explanatory variable is used.

Next, a first example of the paper-feed logistic regression model of the present invention is described. The first example of the paper-feed logistic regression model is expressed by the following equations (2):

$$F_{p1}(Z_{p1}) = \frac{1}{1+\exp(-Z_{p1})} \tag{2}$$

$$Z_{p1} = \sum_{i=0}^{4} \beta_{p1i} X_{p1i}$$

$F_{p1}(Z_{p1})$: objective variable
$\beta_{p1i}$: regression coefficient
$X_{p1i}$: explanatory variable
$F_{p1}(Z_{p1})$: paper-feed trouble risk
$X_{p10}$: total number of paper jams
$X_{p11}$: total number of document paper jams
$X_{p12}$: average number of paper sheets fed between two paper jams
$X_{p13}$: total number of paper local failures
$X_{p14}$: paper-feed critical rate In each of the following examples of the paper-feed logistic regression model of the present invention, the objective variable is "0" in a normal state and "1" in a failed state. A logistic regression analysis is carried out with the use of observed values that are the internal information acquired in a failed state that causes a paper jam and in a normal state. In this manner, an estimate value of the regression coefficient is determined.

In general, a failure that adversely affects the paper feed occurs as a paper jam or a document paper jam. As the average number of paper sheets fed between two paper jams decreases, failures occur more frequently. A paper jam is detected through an error in the paper-feed sensor. Also, as the paper-feed critical rate and the total number of fed paper sheets increase, the failure probability becomes higher.

With this structure, the explanatory variable of the paper-feed logistic regression model includes at least one variable among the number of paper jams, the number of document paper jams, the average number of paper sheets fed between two paper jams, the number of paper local failures, the total number of fed paper sheets, and the paper-feed critical rate. Accordingly, the degree of risk can be calculated more accurately than in a case where a paper-feed logistic regression model not having any of the variables as the explanatory variable is used.

Next, a first example of the total logistic regression model of the present invention is described. The first example of the total logistic regression model is expressed by the following equations (3):

$$F_{a1}(Z_{a1}) = \frac{1}{1+\exp(-Z_{a1})} \tag{3}$$

$$Z_{a1} = \sum_{i=0}^{9} \beta_{a1i} X_{a1i}$$

$F_{\alpha1}(Z_{\alpha1})$: objective variable
$\beta_{\alpha1i}$: regression coefficient
$X_{\alpha1i}$: explanatory variable
$F_{\alpha1}(Z_{\alpha1})$: total trouble risk $X_{\alpha 10}$: total number of system failures
$X_{\alpha 11}$: total number of image-quality local failures
$X_{\alpha 12}$: image-quality sensor measurement value
$X_{\alpha 13}$: average number of paper sheets fed between two operation errors
$X_{\alpha 14}$: image-quality critical rate
$X_{\alpha 15}$: total number of paper jams
$X_{\alpha 16}$: total number of document paper jams
$X_{\alpha 17}$: average number of paper sheets fed between two paper jams
$X_{\alpha 18}$: total number of paper local failures
$X_{\alpha 19}$: paper-feed critical rate In each of the following examples of the total logistic regression model of the present invention, the objective variable is "0" in a normal state and "1" in a failed state. A logistic regression analysis is carried out with the use of observed values that are the internal information acquired in all the failed states that cause failures in the image forming apparatus and in normal states. In this manner, an estimate value of the regression coefficient is determined.

Next, a second example of the image-quality logistic regression model of the present invention is described. The second example of the image-quality logistic regression model is expressed by the following equations (4):

$$F_{g2}(Z_{g2}) = \frac{1}{1+\exp(-Z_{g2})} \tag{4}$$

$$Z_{g2} = \beta_{g2f} X_{g2f} + \beta_{g2e} X_{g2e}$$

$$X_{g2f} = x_{g2f0} + x_{g2f1} + x_{g2f2} + x_{g2f3} + x_{g2f4} + x_{g2f5}$$

$$X_{g2e} = x_{g2e}$$

$F_{g2}(Z_{g2})$ objective variable
$\beta_{g2f}$, $\beta_{g2e}$: regression coefficients
$X_{g2f}$, $X_{g2e}$: explanatory variables
$F_{g2}(Z_{g2})$ image-quality degradation risk
$x_{g2f0}$: number of non-jam-triggering ESS fan failures
$x_{g2f1}$: number of non-jam-triggering IOT logic failures
$x_{g2f2}$: number of non-jam-triggering sensor-C failures
$x_{g2f3}$: number of non-jam-triggering software failures
$x_{g2f4}$: number of non-jam-triggering USB opening failures
$x_{g2f5}$: number of non-jam-triggering communication failures
$x_{g2e}$: number of formed images Next, a second example of the paper-feed logistic regression model of the present invention is described. The second example of the paper-feed logistic regression model is expressed by the following equations (5):

$$F_{p2}(Z_{p2}) = \frac{1}{1+\exp(-Z_{p2})} \tag{5}$$

$$Z_{p2} = \beta_{p2j} X_{p2j} + \beta_{p2e} X_{p2e}$$

$$X_{p2j} = x_{p2j0} + x_{p2j1} + x_{p2j2} + x_{p2j3} + x_{p2j4} + x_{p2j5}$$

$$X_{p2e} = x_{p2e}$$

$F_{p2}(Z_{p2})$: objective variable
$\beta_{p2f}$, $\beta_{p2e}$: regression coefficients
$X_{p2f}$, $X_{p2e}$: explanatory variables
$F_{p2}(Z_{p2})$ paper-feed trouble risk
$x_{p2j0}$: number of fuser paper jams
$x_{p2j1}$: number of registration paper jams
$x_{p2j2}$: number of jam-triggering sensor-C failures
$x_{p2j3}$: number of jam-triggering software failures
$x_{p2j4}$: number of jam-triggering USB opening failures
$x_{p2j5}$: number of jam-triggering communication failures
$x_{p2e}$: number of formed images Next, a second example of the total logistic regression model of the present invention is described. The second example of the total logistic regression model is expressed by the following equations (6):

$$F_{a2}(Z_{a2}) = \frac{1}{1+\exp(-Z_{a2})} \tag{6}$$

$$Z_{a2} = \beta_{a2f} X_{a2f} + \beta_{a2j} X_{a2j} + \beta_{a2e} X_{a2e}$$

$$X_{a2f} = x_{a2f0} + x_{a2f1} + x_{a2f2} + x_{a2f3} + x_{a2f4} + x_{a2f5}$$

$$X_{a2j} = x_{a2j0} + x_{a2j1} + x_{a2j2} + x_{a2j3} + x_{a2j4} + x_{a2j5}$$

$$X_{a2e} = x_{a2e}$$

$F_{\alpha 2}(Z_{\alpha 2})$ objective variable
$\beta_{\alpha 2f}$, $\beta_{\alpha a2j}$, $\beta_{\alpha 2e}$: regression coefficients
$X_{\alpha 2f}$, $X_{\alpha 2j}$, $X_{\alpha 2e}$: explanatory variables
$F_{\alpha 2}(Z_{\alpha 2})$ total trouble risk
$x_{\alpha 2f0}$: number of non-jam-triggering ESS fan failures
$x_{\alpha 2f1}$: number of non-jam-triggering IOT logic failures
$x_{\alpha 2f2}$: number of non-jam-triggering sensor-C failures
$x_{\alpha 2f3}$: number of non-jam-triggering software failures
$x_{\alpha 2f4}$: number of non-jam-triggering USB opening failures
$x_{\alpha 2f5}$: number of non-jam-triggering communication failures
$x_{\alpha 2j0}$: number of fuser paper jams
$x_{\alpha 2j1}$: number of registration paper jams
$x_{\alpha 2j2}$: number of jam-triggering sensor-C failures
$x_{\alpha 2j3}$: number of jam-triggering software failures
$x_{\alpha 2j4}$: number of jam-triggering USB opening failures
$x_{\alpha 2j5}$: number of jam-triggering communication failures
$x_{\alpha 2e}$: number of formed images The explanatory variables in the above equations (4) through (6) are the values obtained from the internal information. More specifically, the explanatory variables include the total sum of the non-jam-triggering information as the internal information, or the total sum of the jam-triggering information as the internal information, or both total sums.

In the above equations (4) through (6), the elapsed time may be used in place of the number of formed images that is the time-course information.

With this structure, the number of formed images and the elapsed time are quantitative values. Accordingly, the risks can be constantly calculated with higher precision than in a case where qualitative parameters such as the learning level or the failure sensing level of the user for the image forming apparatus are used as the explanatory variables.

Next, a third example of the image-quality logistic regression model of the present invention is described. The third example of the image-quality logistic regression model is expressed by the following equations (7):

$$F_{g3}(Z_{g3}) = \frac{1}{1+\exp(-Z_{g3})} \tag{7}$$

$$Z_{g3} = \beta_{g3f} X_{g3f} + \beta_{g3e} X_{g3e}$$

$$X_{g3f} = \alpha_{g3f0} * (x_{g3f0} + x_{g3f1}) + \alpha_{g3f1} * (x_{g3f2} + x_{g3f3}) + \alpha_{g3f2} * (x_{g3f4} + x_{g3f5})$$

$$X_{g3e} = x_{g3e}$$

$F_{g3}(Z_{g3})$: objective variable
$\beta_{g3f}$, $\beta_{g3e}$: regression coefficients
$X_{g3f}$, $X_{g3e}$: explanatory variables
$F_{g3}(Z_{g3})$ image-quality degradation risk
$\alpha_{ag3f0}$, $\alpha_{ag3f1}$, $\alpha_{g3f2}$: weighting coefficients
$x_{g3f0}$: number of non-jam-triggering ESS fan failures
$x_{g3f1}$: number of non-jam-triggering IOT logic failures
$x_{g3f2}$: number of non-jam-triggering sensor-C failures
$x_{g3f3}$: number of non-jam-triggering software failures
$x_{g3f4}$: number of non-jam-triggering USB opening failures
$x_{g3f5}$: number of non-jam-triggering communication failures
$x_{g3e}$: number of formed images Next, a third example of the paper-feed logistic regression model of the present invention is described. The third example of the paper-feed logistic regression model is expressed by the following equations (8):

$$F_{p3}(Z_{p3}) = \frac{1}{1+\exp(-Z_{p3})} \tag{8}$$

$$Z_{p3} = \beta_{p3j}X_{p3j} + \beta_{p3e}X_{p3e}$$

$$X_{p3j} = \alpha_{p3j0} * (x_{p3j0} + x_{p3j1}) + \alpha_{p3j1} * (x_{p3j2} + x_{p3j3}) + \alpha_{p3j2} * (x_{p3j4} + x_{p3j5})$$

$$X_{p3e} = x_{p3e}$$

$F_{p3}(Z_{p3})$: objective variable
$\beta_{p3f}$, $\beta_{p3e}$: regression coefficients
$X_{p3f}$, $X_{p3e}$: explanatory variables
$F_{p3}(Z_{p3})$: paper-feed trouble risk
$\alpha_{p3j0}$, $\alpha_{p3j1}$, $\alpha_{p3j2}$: weighting coefficients
$x_{p3j0}$: number of fuser paper jams
$x_{p3j1}$: number of registration paper jams
$x_{p3j2}$: number of jam-triggering sensor-C failures
$x_{p3j3}$: number of jam-triggering software failures
$x_{p3j4}$: number of jam-triggering USB opening failures
$x_{p3j5}$: number of jam-triggering communication failures
$x_{p3e}$: number of formed images Next, a third example of the total logistic regression model of the present invention is described. The third example of the total logistic regression model is expressed by the following equations (9):

$$F_{a3}(Z_{a3}) = \frac{1}{1+\exp(-Z_{a3})} \tag{9}$$

$$Z_{a3} = \beta_{a3f}X_{a3f} + \beta_{a3j}X_{a3j} + \beta_{a3e}X_{a3e}$$

$$X_{a3f} = \alpha_{a3f0} * (x_{a3f0} + x_{a3f1}) + \alpha_{a3f1} * (x_{a3f2} + x_{a3f3}) + \alpha_{a3f2} * (x_{a3f4} + x_{a3f5})$$

$$X_{a3j} = \alpha_{a3j0} * (x_{a3j0} + x_{a3j1}) + \alpha_{a3j1} * (x_{a3j2} + x_{a3j3}) + \alpha_{a3j2} * (x_{a3j4} + x_{a3j5})$$

$$X_{a3e} = x_{a3e}$$

$F_{\alpha3}(Z_{\alpha3})$ objective variable
$\beta_{\alpha3f}$, $\beta_{\alpha3j}$, $\beta_{\alpha3e}$: regression coefficients
$X_{\alpha3f}$, $X_{\alpha3j}$, $X_{\alpha3e}$: explanatory variables
$F_{\alpha3}(Z_{\alpha3})$ total trouble risk
$\alpha_{\alpha3f0}$, $\alpha_{\alpha sf1}$, $\alpha_{\alpha3f2}$, $\alpha_{\alpha3j0}$, $\alpha_{\alpha3j1}$, $\alpha_{\alpha3j2}$: weighting coefficients
$x_{\alpha3f0}$: number of non-jam-triggering ESS fan failures
$x_{\alpha3f1}$: number of non-jam-triggering IOT logic failures
$x_{\alpha3f2}$: number of non-jam-triggering sensor-C failures
$x_{\alpha3f3}$: number of non-jam-triggering software failures
$x_{\alpha3f4}$: number of non-jam-triggering USB opening failures
$x_{\alpha3f5}$: number of non-jam-triggering communication failures
$x_{\alpha3j0}$: number of fuser paper jams
$x_{\alpha3j1}$: number of registration paper jams
$x_{\alpha3j2}$: number of jam-triggering sensor-C failures
$x_{\alpha3j3}$: number of jam-triggering software failures
$x_{\alpha3j4}$: number of jam-triggering USB opening failures
$x_{\alpha3j5}$: number of jam-triggering communication failures
$x_{\alpha3e}$: number of formed images The explanatory variables in the above equations (7) through (9) are the values obtained from the internal information. More specifically, the explanatory variables include the weighted sum of the non-jam-triggering information as the internal information and the weighted sum of the jam-triggering information as the internal information.

In general, paper jam occurrences often depend on the humidity in the use environment or the state of the used paper sheet, and most paper jams fortuitously occur. On the other hand, operation errors of components other than paper jams tend to repeatedly appear, except for operation errors that are fortuitously caused due to noise. Such operation errors often adversely affect the image quality. The degree of correlation between the jam failure information and non-jam failure information is normally low.

A paper jam is regarded as a jam failure in a component. As the number of jam-triggering errors increases, the paper jam occurrence probability becomes higher. Further, as the number of non-jam-triggering errors increases, the non-jam-related operation error occurrence probability becomes higher.

With the structure of this exemplary embodiment, the total risk is calculated in a complementary manner. Accordingly, the risks can be calculated more accurately than in a case where a model that does not define risks with the jam failure information or the non-jam failure information is used.

Referring now to FIG. 5, the characteristics of each risk calculated by a logistic regression model having time-course information as an explanatory variable are described. FIG. 5 shows examples of effects of the time-course information on risks.

The upper chart in FIG. 5 shows the change with time in risks that are calculated by logistic regression models that do not contain the time-course information as an explanatory variable (the first examples of the logistic regression models). The lower chart in FIG. 5 shows the change with time in risks that are calculated by logistic regression models that contain the time-course information as an explanatory variable (the second or third examples of the logistic regression models).

In each of the charts in FIG. 5, the ordinate axis indicates the degree of risk, and the abscissa axis indicates time. Each of the charts shows the development of the image-quality degradation risk and the paper-feed trouble risk that are calculated during the same time period with the use of the internal information acquired from the same image forming apparatus.

As can be seen from FIG. 5, errors are caused in the image forming apparatus in time periods IT1 and IT2, but no errors are caused during any other time period. Accordingly, no errors are caused in the image forming apparatus after the time period IT1 and before the time period IT2. The time period in which no errors are caused is hereinafter referred to as the no-error occurrence period IO.

The upper chart in FIG. 5 shows that the image-quality degradation risk and the paper-feed trouble risk draw horizontal lines during the no-error occurrence period IO, while the lower chart in FIG. 5 shows that the image-quality degradation risk and the paper-feed trouble risk gradually decrease during the no-error occurrence period IO.

In a case where the image forming apparatus is in a failed state due to a fortuitously caused noise or an inadvertent operation, for example, the image forming apparatus is put back into a normal state, without any failure prevention measures being taken. The recovery of the image forming apparatus to a normal state is proved by the fact that no errors are caused thereafter.

Accordingly, with this structure, the degree of risk that is the objective variable of a logistic regression model is defined by the time-course information. Thus, the degree of risk can be calculated with higher precision than in a case where a model that does not involve time-course information as an explanatory variable is used, for example.

Referring now to FIG. 6, the correlation between the internal information and the weighting coefficients is described. FIG. 6 shows the correlation between the internal information and the weighting coefficients.

The internal information used in the third example of the image-quality logistic regression model, the paper-feed logistic regression model, and the total logistic regression model of the present invention is divided into the jam failure information and non-jam failure information, as shown in FIG. 6. This is because the image-quality degradation risk is defined directly by the non-jam failure information and indirectly by the jam failure information, while the paper-feed trouble risk is defined directly by the jam failure information and indirectly by the non-jam failure information.

The jam failure information and the non-jam failure information are prioritized as "large", "medium", or "small", based on the repetitive nature of each operation error and the degree of each error in the image forming apparatus. More specifically, errors such as a paper jam caused at the fuser roller or the registration roller, an error in the ESS fan, and an IOT logic error are highly likely to recur, and have high probabilities of causing a serious paper jam or adversely affecting the image quality. On the other hand, errors such as failures in opening a USB port and communication failures depend on the status of the device connected to the USB port or the like, and are unlikely to recur. Such errors are also unlikely to cause paper jams or adversely affect the image quality.

Accordingly, in the third example of the regression model, the number of non-jam-triggering ESS fan failures and the number of non-jam-triggering IOT logic failures of the non-jam failure information each have an effect evaluated as "large". The number of non-jam-triggering sensor-C failures and the number of non-jam-triggering software failures each have an effect evaluated as "medium". The number of non-jam-triggering USB opening failures and the number of non-jam-triggering communication failures each have an effect evaluated as "small".

In the third example, the explanatory variables are determined by adding weighting coefficients "$\alpha$", "$\beta$", and "$\gamma$", in descending order of those effect sizes.

Further, of the jam failure information, the number of paper jams caused at the fuser roller and the number of paper jams caused at the registration roller each have an effect evaluated as "large". The number of jam-triggering sensor-C failures and the number of jam-triggering software failures each have an effect evaluated as "medium". The number of jam-triggering USB opening failures and the number of jam-triggering communication failures each have an effect evaluated as "small".

In the third example, the explanatory variables are determined by adding weighting coefficients "$\delta$", "$\epsilon$", and "$\zeta$", in descending order of those effect sizes.

The memory 202 stores one or more of the first through third examples of image-quality logistic regression models and paper-feed logistic regression models that define an estimate value of each regression coefficient with the use of the internal information classified according to the placement area of the image forming apparatus, or the machine model of the image forming apparatus, or both the placement area and the machine model of the image forming apparatus.

In general, some of the components in an image forming apparatus have failures and operation errors that directly result in paper jams or degradation of the image quality, while some other components have failures and operation errors that indirectly result in paper jams or degradation of the image quality. Those components have different effects on failures.

With this structure, the explanatory variables can be determined by adding weights to variables that are considered to define the objective variable. Thus, the degree of risk can be calculated with higher precision than in a case where a model that does not involve weighting is used.

Referring back to FIG. 2, explanation of the structure of the failure prevention diagnosis support device 200 is continued. The controller 203 will be described later.

The display 204 is formed with a liquid crystal display, a plasma display, or a CRT, for example. The display 204 is connected to the controller 203. The display 204 is controlled by the controller 203, so as to display the risk information or the like that is calculated under control of the controller 203.

The input portion 205 is formed with a touch panel, a mouse, and a keyboard, for example. The input portion 205 is connected to the controller 203. The input portion 205 is operated by a user, so as to input the service engineer identification information, the placement area identification information, the image forming apparatus identification information, the machine model identification information, and various execution instructions to the controller 203.

The failure diagnosis portion 206 is formed with an external storage device such as a hard disk, an internal storage device such as a RAM, and an operation device such as a CPU, though not shown in the drawing. The operation device executes a program that processes information stored in storage devices and is stored in the external storage device, so as to provide the later described various functions.

The failure diagnosis portion 206 analyzes a failure diagnosis model involving models of causes of failures in the image forming apparatuses 101 through 10m. In this manner, a failure in a component or a set of components in the image forming apparatuses 101 through 10m is diagnosed.

The failure diagnosis portion 206 then transmits the failure detection result to the controller 203. Under the control of the controller 203, the failure detection result is displayed on the display 204 or the displays of the remote terminals 401 through 40n (hereinafter referred to as the display 204 and the other displays).

Figure 7:
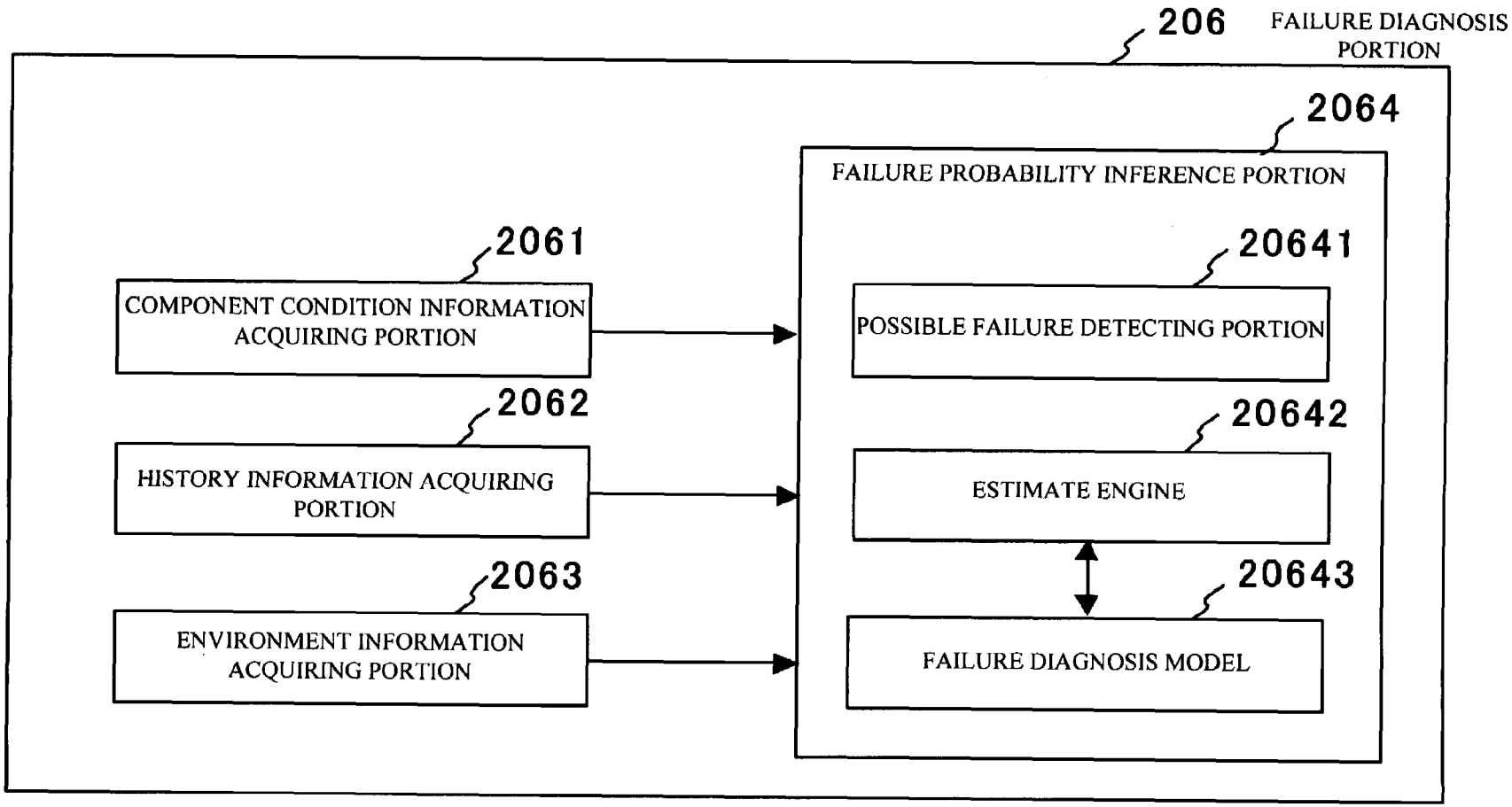
FIG. 7 illustrates an example structure of the failure diagnosis portion.

Referring now to FIG. 7, the structure of the failure diagnosis portion 206 is described. FIG. 7 illustrates an example structure of the failure diagnosis portion 206.

The failure diagnosis portion 206 includes a component condition information acquiring portion 2061, a history information acquiring portion 2062, an environment information acquiring portion 2063, and a failure probability inference portion 2064.

The component condition information acquiring portion 2061, the history information acquiring portion 2062, and the environment information acquiring portion 2063 (hereinafter referred to as the component condition information acquiring portion 2061 and the others) are connected to the controller 203 and the failure probability inference portion 2064, though not shown in the drawing.

The component condition information acquiring portion 2061 and the others acquire various internal information relating to the image forming apparatuses 101 through 10m subjected to detection of failures to be input to a failure diagnosis model 20643, from the chronological information table TH of the memory 202 via the controller 203. The component condition information acquiring portion 2061 and the others transmit the acquired information to the failure probability inference portion 2064.

More specifically, the component condition information acquiring portion 2061 acquires component condition information that is a piece of the internal information acquired by a sensor or the like of the image forming apparatuses 101 through 10m subjected to failure detection and is the information indicating the operating condition of each component based on the internal information stored in the chronological information table TH. Here, a "component" is a part or a set of parts of the image forming apparatus.

The history information acquiring portion 2062 acquires a result of a monitoring operation performed to monitor the use of the image forming apparatus subjected to failure detection, based on the internal information stored in chronological order in the chronological information table TH.

The environment information acquiring portion 2063 acquires the environment information that indicates the environment of the image forming apparatus subjected to failure detection and is stored in the chronological information table TH.

The failure probability inference portion 2064 is connected to the component condition information acquiring portion 2061, the history information acquiring portion 2062, and the environment information acquiring portion 2063. The failure probability inference portion 2064 is also connected to the input portion 205 or the input portions of the remote terminals 401 through 40n (hereinafter referred to as the input portions 205 and the others) via the controller 203.

The failure probability inference portion 2064 includes a possible failure detecting portion 20641, an inference engine 20642, and one or more failure diagnosis models 20643.

The failure probability inference portion 2064 obtains the information acquired by the component condition information acquiring portion 2061 and the others. The failure probability inference portion 2064 also obtains failure information in different operating conditions through user operations, from the input portion 205 and the others via the controller 203.

The failure probability inference portion 2064 calculates a failure probability of each failure cause listed in each model, based on the information obtained from the component condition information acquiring portion 2061 and the others and the input portion 205 and the others, and the diagnosis model 20643 suitable for diagnosing failures in the image forming apparatuses 101 through 10m subjected to failure detection.

The possible failure detecting portion 20641 narrows possible failure causes, based on the later described failure cause probability calculated by the inference engine 20642.

The inference engine 20642 calculates a probability of each failure cause being the main cause of an actual failure (the failure cause probability), based on the information acquired from the component condition information acquiring portion 2061 and the others, and the input portions 205 and the others.

The diagnosis model 20643 is a failure diagnosis model having model causes of failures in the image forming apparatuses 101 through 10m, and is used for calculating the failure cause probability.

Here, a Bayesian network is used for the inference engine 20642 that calculates the failure cause probability. In a Bayesian network, problem areas having complicated correlations are represented in the form of a network having a graph structure in which the correlations between variables are shown by linking them to one another, and the dependencies between the variables are shown in an oriented graph. The failure diagnosis models in the present invention are constructed with the use of such a Bayesian network.

Here, the failure diagnosis models and the image forming apparatuses 101 through 10m may be conventional failure diagnosis models and conventional image forming apparatuses.

Figure 8:
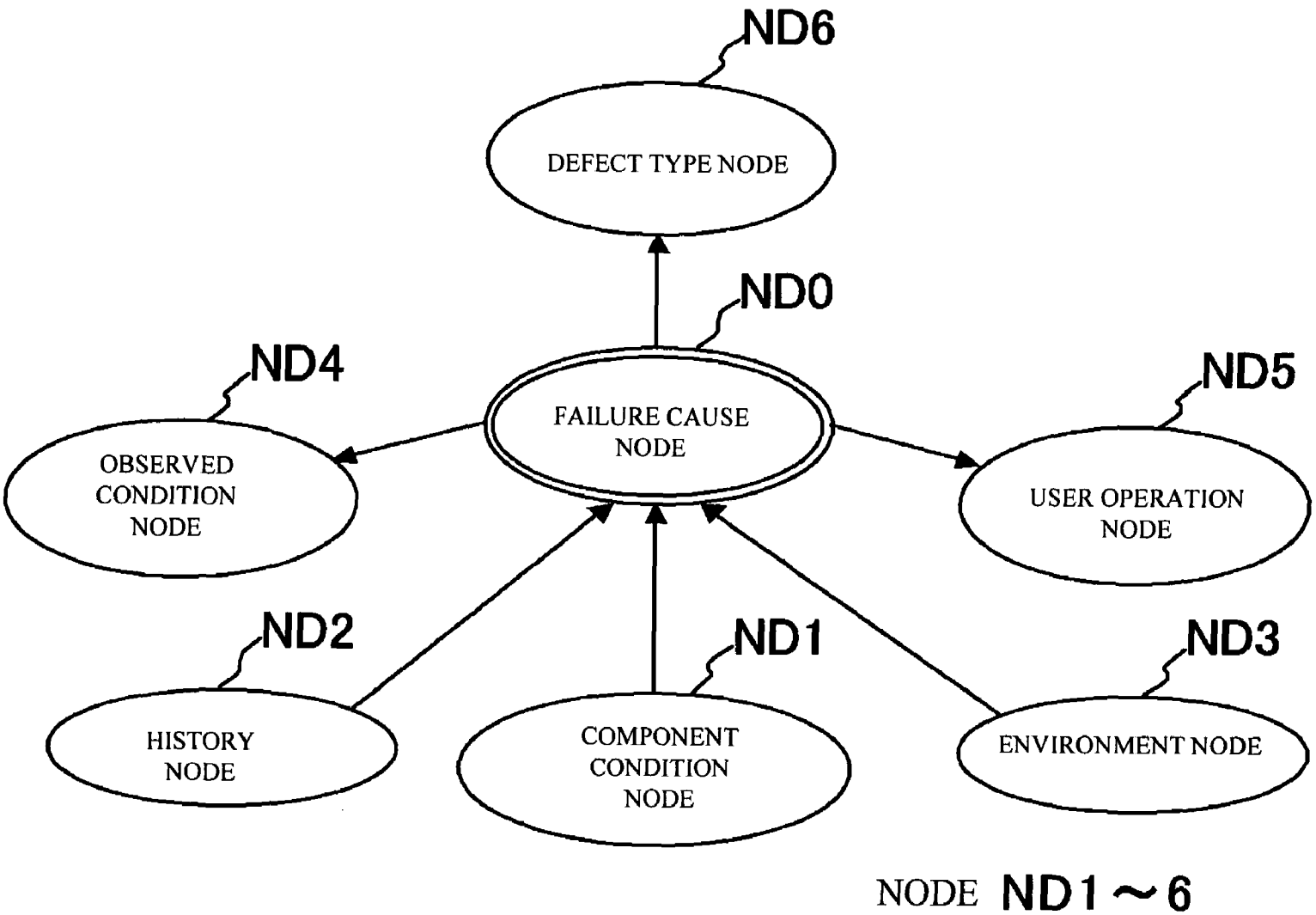
FIG. 8 is a schematic view of an example structure of a Bayesian network in a case where failure detection is performed for an image defect.

Referring now to FIG. 8, the structure of a Bayesian network used in a case where a failure that adversely affects the image quality (hereinafter referred to simply as an image defect) is to be diagnosed is described. FIG. 8 is a schematic view of an example structure of a Bayesian network used in a case where an image defect is to be diagnosed.

As shown in FIG. 8, the Bayesian network includes a failure cause node ND0 that represents a cause of an image defect, a component condition node ND1 that represents the condition information as to a part or component of the image forming apparatuses 101 through 10m, a history information node ND2 that represents the history information as to the image forming apparatuses 101 through 10m, an environment information node ND3 that represents the information relating to the surrounding environment in which the image forming apparatuses 101 through 10m are placed, an observed condition node ND4 that represents image defect condition information, a user operation node ND5 that represents retry result information obtained through user operations, and a defect type node ND6.

The failure cause node ND0 is a node that represents a cause of an image defect. The probability at this node is calculated so as to determine whether there is a failure. A probability table that collectively shows probability data representing the correlations between causes and failures is stored in each node. The initial value of the probability data can be determined by the data obtained at the times of past failures and the MTBF (Mean Time Between Failures) of each component.

The component condition node ND1 is a node that represents the condition of each component, and is the information obtained from the internal information acquired by a sensor or the like that observes the condition of each component. The information contains the temperature of each component, the applied voltage, the patch density, the amount of remaining toner, and the likes.

The history information node ND2 represents the usage status of the image forming apparatuses 101 through 10m, using the history of printed sheet number of each component. The number of printed sheets directly affects the condition of each component, causing wear or deterioration in each component.

The environment information node ND3 represents the surrounding environment conditions that affect the condition of each component. In this exemplary embodiment, the temperature and humidity are the surrounding environment conditions that directly affect the image forming condition and operating condition of each component.

The observed condition node ND4 represents the observed condition of a defect that occurs in an output image, and is the information that is observed and input by a user. For example, the information contains the shape of the defect, the size, the density, the outline, the orientation, the location, the cyclicity, and the occurrence site.

The user operation node ND5 is the information for causing the image forming apparatuses 101 through 10m to perform the same operation under different operating conditions, and also contains information about modified operating conditions.

The defect type node ND6 represents the type of each image defect, such as a line defect, a dot defect, a white defect, an irregular density defect. The type of an image defect is first determined, and the node is established. The information from the other nodes (ND1 through ND5) is then input, if necessary, so as to estimate the cause of the failure.

Those nodes are linked to one another, so as to indicate the correlations between "causes" and "results". For instance, the relationship between the "failure cause node" and the "observed condition node ND4" shows that an "observed conduction (such as a low density, a thread-like state, or a belt-like state)" represented by the "observed condition node ND4" appears due to the "cause" represented by the "failure cause node". The relationship between the "history information node ND2" and the "cause node" shows that the "cause (such as component deterioration)" is caused by the "condition based on the history information (such as a large number of copied sheets or many service years)".

Figure 9:
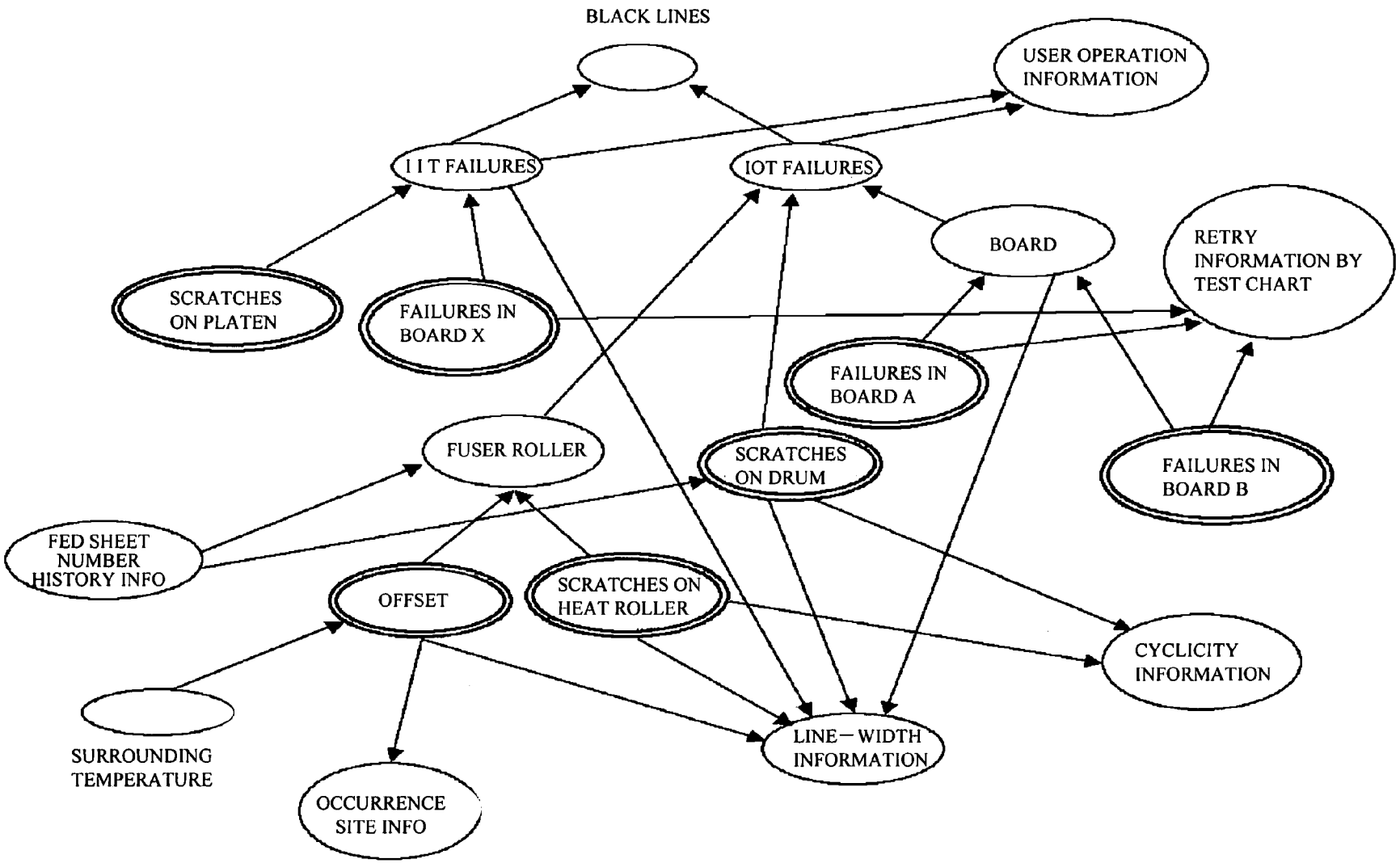
FIG. 9 shows an example of a Bayesian network in a case where black lines appear in an example structure for diagnosis failures due to image defects.

Referring now to FIG. 9, specific examples of failure diagnosis models are described. FIG. 9 shows an example of a Bayesian network that can be seen when black lines appear in an image in an example structure for image failure detection.

As shown in FIG. 9, the nodes are linked so as to indicate the relationship between "causes" and "results". For instance, the relationship between "scratches on the drum" and "line-width information" shows that the "line-width information" indicating narrow lines appears due to the "scratches on the drum".

Meanwhile, the relationship between "fed sheet number history information" and the "fuser roller" shows that the probability of a black-line occurrence due to deterioration of the "fuser roller" becomes higher when the "number of fed sheets" is large (when the number of fed sheets is more than a predetermined value).

The initial value of the probability data of each node is determined based on the past data. The probability data of each node may be updated on a regular basis, using statistical data of market troubles such as the frequency of replacements of parts and the frequency of failure occurrences.

Referring back to FIG. 2, explanation of the structure of the failure prevention diagnosis support device 200 is continued.

Although not shown in FIG. 2, the controller 203 is formed with an external storage device such as a hard disk, an internal storage device such as a RAM, an operation device such as a CPU, and the likes. The operation device executes a program stored in an external storage device or the like for processing information stored in a memory device, so as to provide the later described various functions.

The controller 203 is connected to the acquiring portion 201, the memory 202, the display 204, the input portion 205, and the failure diagnosis portion 206.

The controller 203 receives the internal information, the environment information, the acquirement time information, the image forming apparatus identification information, and the likes, from the acquiring portion 201. The controller 203 then stores the internal information, the acquirement time information, and the image forming apparatus identification information in the chronological information table TH of the memory 202, with those pieces of information being associated with one another.

The controller 203 controls the program for calculations, and stores the calculated total risk, image-quality degradation risk, paper-feed trouble risk in the chronological information table TH of the memory 202, with those risks being associated with the internal information used for the calculations.

The controller 203 also stores the image forming apparatus identification information received from the input portion 205 and the others, the placement area identification information as to the image forming apparatus identified by the image forming apparatus identification information, the service engineer identification information, and the image forming apparatus model identification information in the machine service table TMT of the memory 202, with those pieces of information being associated with one another. More specifically, the controller 203 controls the execution of the program for managing the information stored in the memory 202, so that a SQL sentence or the like is created and an instruction described in the SQL sentence is executed.

The controller 203 further acquires the placement area identification information that is input by the input portion 205 and the others, and the internal information and the image forming apparatus identification information that are associated with the acquired placement area identification information and are stored in the memory 202.

The controller 203 also acquires the image forming apparatus identification information that is associated with the service engineer identification information input by the input portion 205 and the others and is stored in the memory 202. The controller 203 then acquires the internal information that is associated with the acquired image forming apparatus identification information and is stored in the memory 202.

The controller 203 then performs a control operation to calculate the degree of risk, with the use of the internal information acquired in accordance with all the acquired image forming apparatus identification information. The controller 203 controls the display 204 and others so as to collectively display the calculated risks and the image forming apparatus identification information associated with each other.

Figure 10:
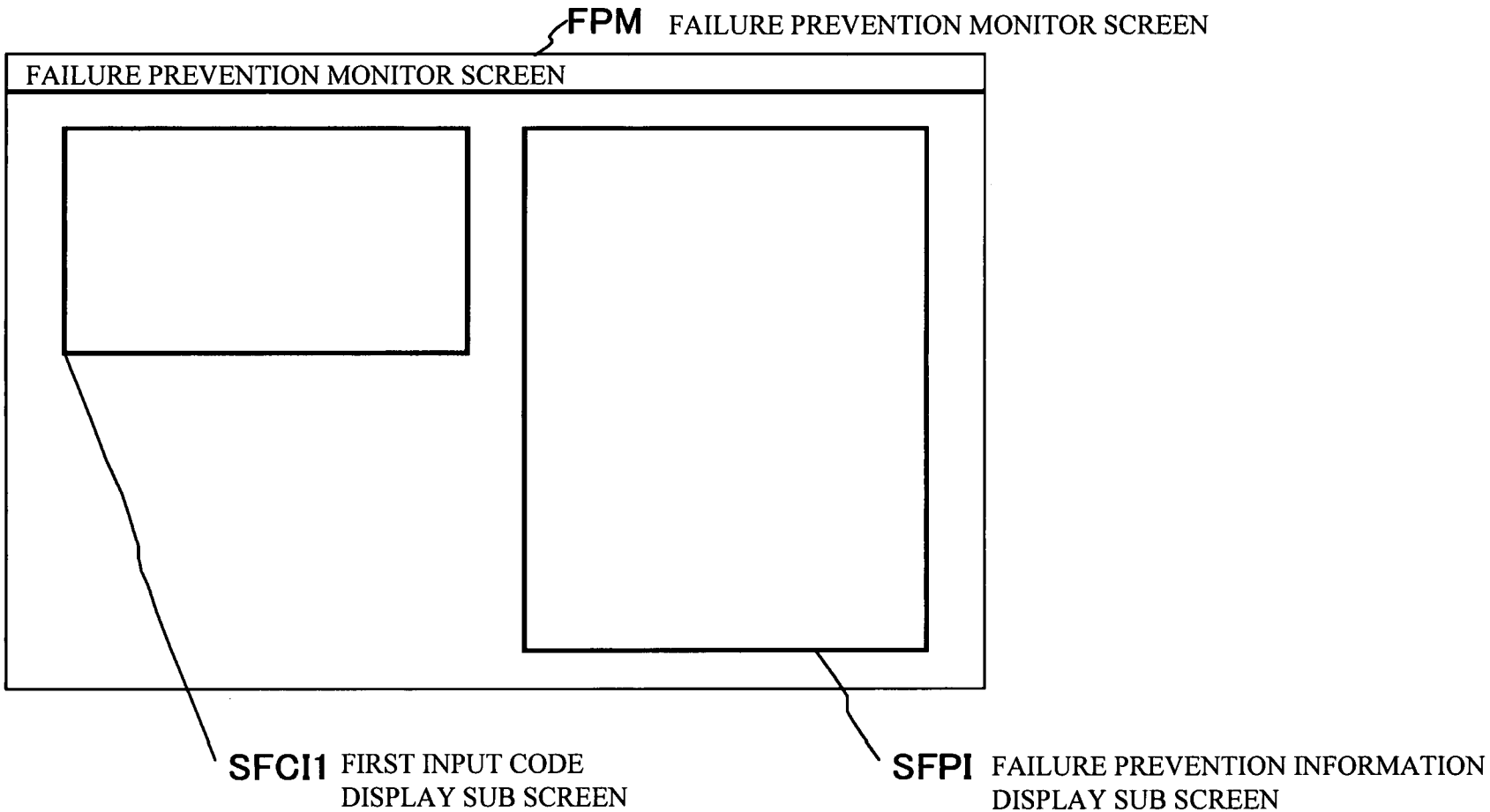
FIG. 10 shows an example of the failure prevention monitor screen to be displayed on the display.

Referring now to FIG. 10, an example of a display screen of the display 204 in a case where the controller 203 performs a control operation so as to collectively display the risks and the image forming apparatus identification information associated with each other is described. FIG. 10 illustrates an example of a failure prevention monitor screen displayed on the display 204 or the like.

The failure prevention monitor screen FPM shown in FIG. 10 is a screen for collectively displaying the risks in the image forming apparatus in descending order, with the risks being associated with the image forming apparatus identification information.

The failure prevention monitor screen FPM is displayed on the display 204 or the like, when the user operates the input portion 205 or the like so as to switch the operation mode of the failure prevention diagnosis support device 200 from a normal operation mode that is the mode for regular operations to a failure prevention monitoring mode that is the mode for monitoring failure preventions in the image forming apparatus.

The failure prevention monitor screen FPM has a first input code display sub screen SFCI1 and a failure prevention information display sub screen SFPI.

The first input code display sub screen SFCI1 is a sub screen for displaying information that is input through the input portion 205 or the like so that the controller 203 can determine the image forming apparatus to be supported.

The failure prevention information display sub screen SFPI is a sub screen for displaying the support information such as the degree of risk in one or more image forming apparatuses designated by the information displayed on the first input code display sub screen SFCI1 and the information input through the input portion 205 or the like.

Figure 11:
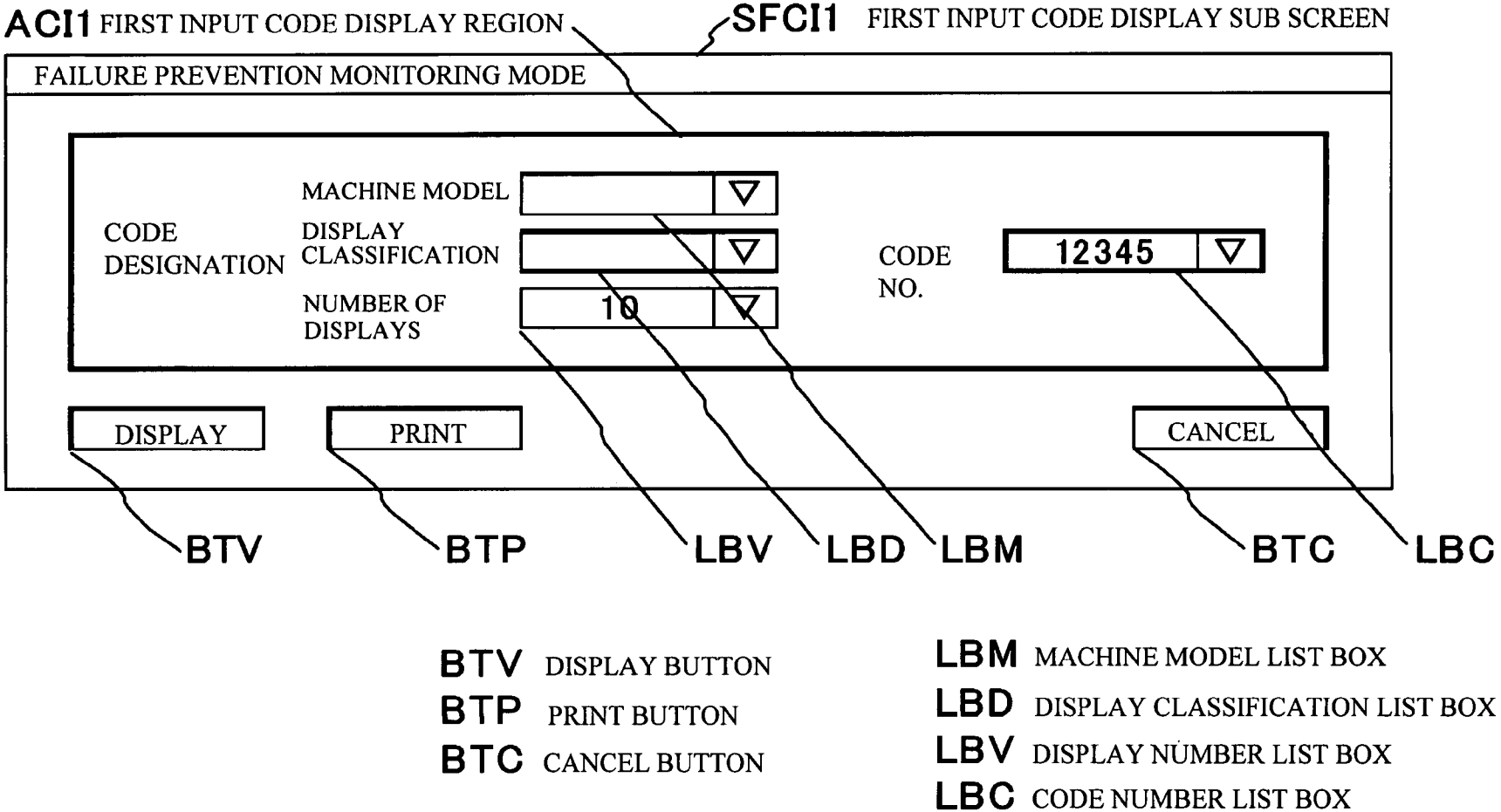
FIG. 11 shows an example of the first input code display sub screen to be displayed on the display.

Referring now to FIG. 11, the first input code display sub screen SFCI1 is described. FIG. 11 shows an example of the first input code display sub screen SFCI1 to be displayed on the display 204 or the like.

The first input code display sub screen SFCI1 is formed with a first input code display region ACI1, a display button BTV, a print button BTP, and a cancel button BTC.

The first input code display region ACIL is the region for displaying the information that is input through the input portion 205 or the like.

The display button BTV shows that an instruction to start supporting the image forming apparatuses 101 through 10m designated by the information displayed in the first input code display region ACI1 can be input by a user touching the display button BTV and thus operating the input portion 205 or the like.

The print button BTP shows that an instruction to print out the support information displayed on the failure prevention information display sub screen SFPI through a printer or the like provided in or connected to the failure prevention diagnosis support device 200, though not shown in the drawing, can be input by a user touching the print button BTP.

The cancel button BTC shows that an instruction to cancel the display on the failure prevention information display sub screen SFPI of FIG. 10 displayed in the failure prevention monitoring mode, which is not the normal operation mode, and to display a screen of the normal operation mode, can be input by a user touching the cancel button BTC.

The first input code display region ACI1 includes a machine model list box LBM, a display classification list box LBD, a display number list box LBV, and a code number list box LBC.

The machine model list box LBM, the display classification list box LBD, the display number list box LBV, and the code number list box LBC display information that is input by a user operating the input portion 205 or the like.

More specifically, the machine model list box LBM displays the machine model identification information.

The display classification list box LBD displays character string information that shows whether the information displayed in the code number list box LBC is the service engineer identification information or the placement area identification information. If the information displayed in the code number list box LBC is the service engineer identification information, the display classification list box LBD displays a character string of "service engineer SE".

The code number list box LBC displays the service engineer identification information or the placement area identification information.

The display number list box LBV displays the maximum number of image forming apparatuses to be supported at the same time by displaying information on the failure prevention information display sub screen SFPI.

Figure 12:
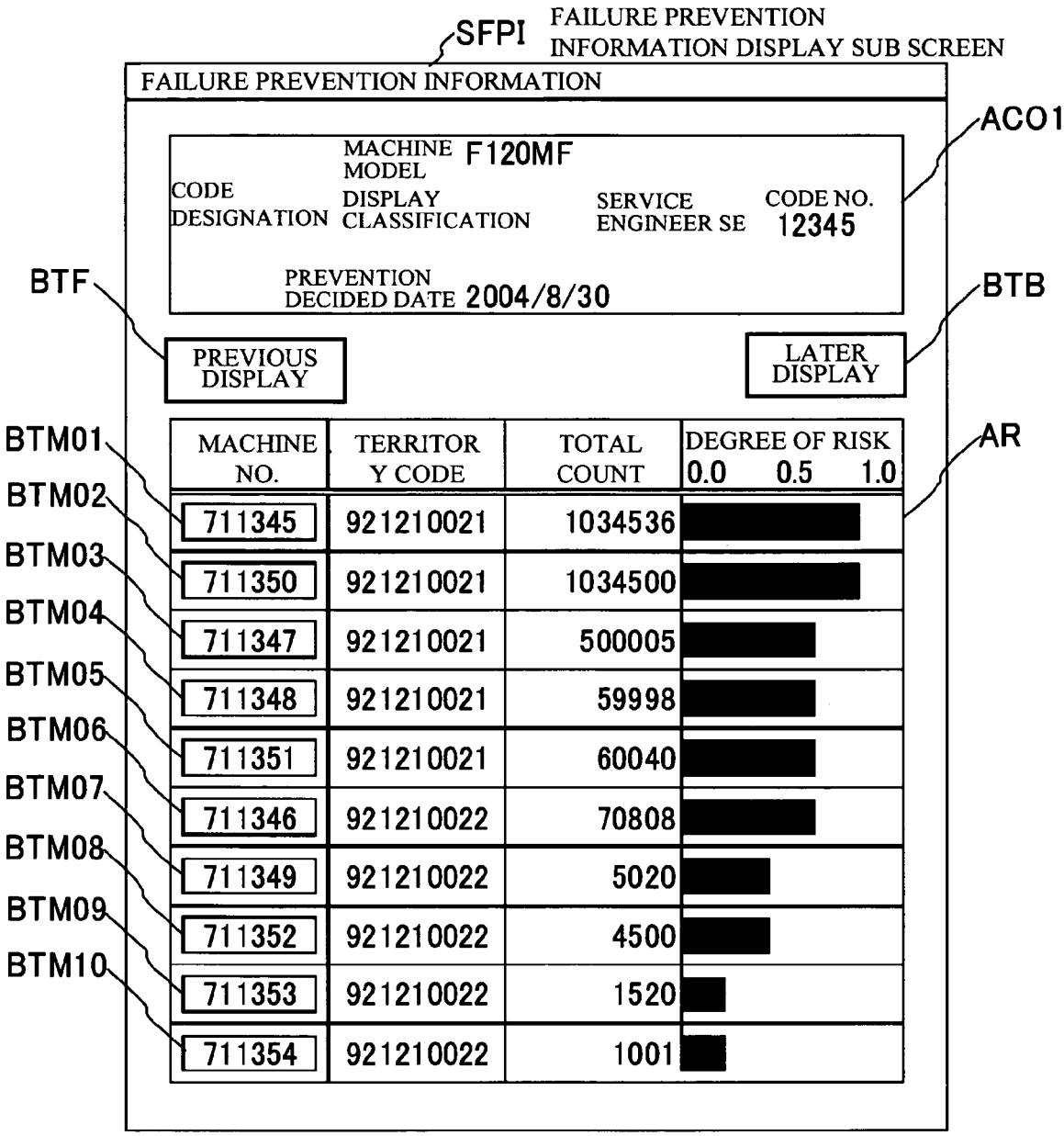
FIG. 12 shows an example of the failure prevention information display sub screen to be displayed on the display.

Referring now to FIG. 12, the failure prevention information display sub screen SFPI is described. FIG. 12 shows an example of the failure prevention information display sub screen SFPI to be displayed on the display 204 or the like.

The failure prevention information display sub screen SFPI includes a first code display region ACO1, a previous list display button BTF, a later list display button BTB, and a failure risk display region AR.

The first code display region ACO1 displays part of the information displayed on the first input code display sub screen SFCI1 and the support date. More specifically, the part of the information is the machine model identification information displayed in the machine list box LBM of the first input code display sub screen SFCI1, the character string displayed in the display classification list box LBD, and the service engineer identification information or the placement area identification information displayed in the code number list box LBC.

The failure risk display region AR displays the image forming apparatus identification information displayed in the first input code display sub screen SFCI1, the image forming apparatus identification information relating to the one or more image forming apparatuses designated by the service engineer identification information or the placement area identification information, the placement area identification information as to the image forming apparatus identified by the designated image forming apparatus identification information, the total number of fed paper sheets that is the internal information, and the degree of risk. Those pieces of information are displayed on the same line, so that the degree of risk is associated with the other pieces of information. The information displayed on the same line is referred to as factor information. Here, the total number of fed paper sheets is displayed as the total counter.

The image forming apparatus identification information on each line of the failure risk display region AR is displayed as a caption of detailed information display buttons BTM01 through BTM10.

Each detailed information display button BTM01 through BTM10 shows that an instruction to cause the display 204 or the like to display a failure prevention time monitor screen FPTM displaying the information relating to the image forming apparatuses 101 through 10m identified by the image forming apparatus identification information displayed as a caption can be input by a user touching the detailed information display buttons BTM01 through BTM10 and operating the input portion 205 or the like. The failure prevention time monitor screen FPTM will be described later.

The lines displayed in the failure risk display region AR form a list that contains the factor information as items. Those lines displayed in the failure risk display region AR show a part or all of the list that is sorted in descending order in terms of the degree of risk that is a piece of the factor information.

More specifically, the failure risk display region AR collectively displays the factor information in descending order in terms of the degree of risk, as in the list, with the number of displays shown in the first input code display region ACIL of the first input code display sub screen SFC being the maximum number of displays.

The previous list display button BTF shows that an instruction to cause the failure risk display region AR to display, instead of the currently displayed factor information, the factor information inserted into the list the maximum number of displays before the currently displayed factor information can be input by a user touching the previous list display button BTF and operating the input portion 205 or the like.

The later list display button BTB shows that an instruction to cause the failure risk display region AR to display, instead of the currently displayed factor information, the factor information inserted into the list the maximum number of displays after the currently displayed factor information can be input by a user touching the later list displaying button BTB and operating the input portion 205 or the like.

Figure 13A:
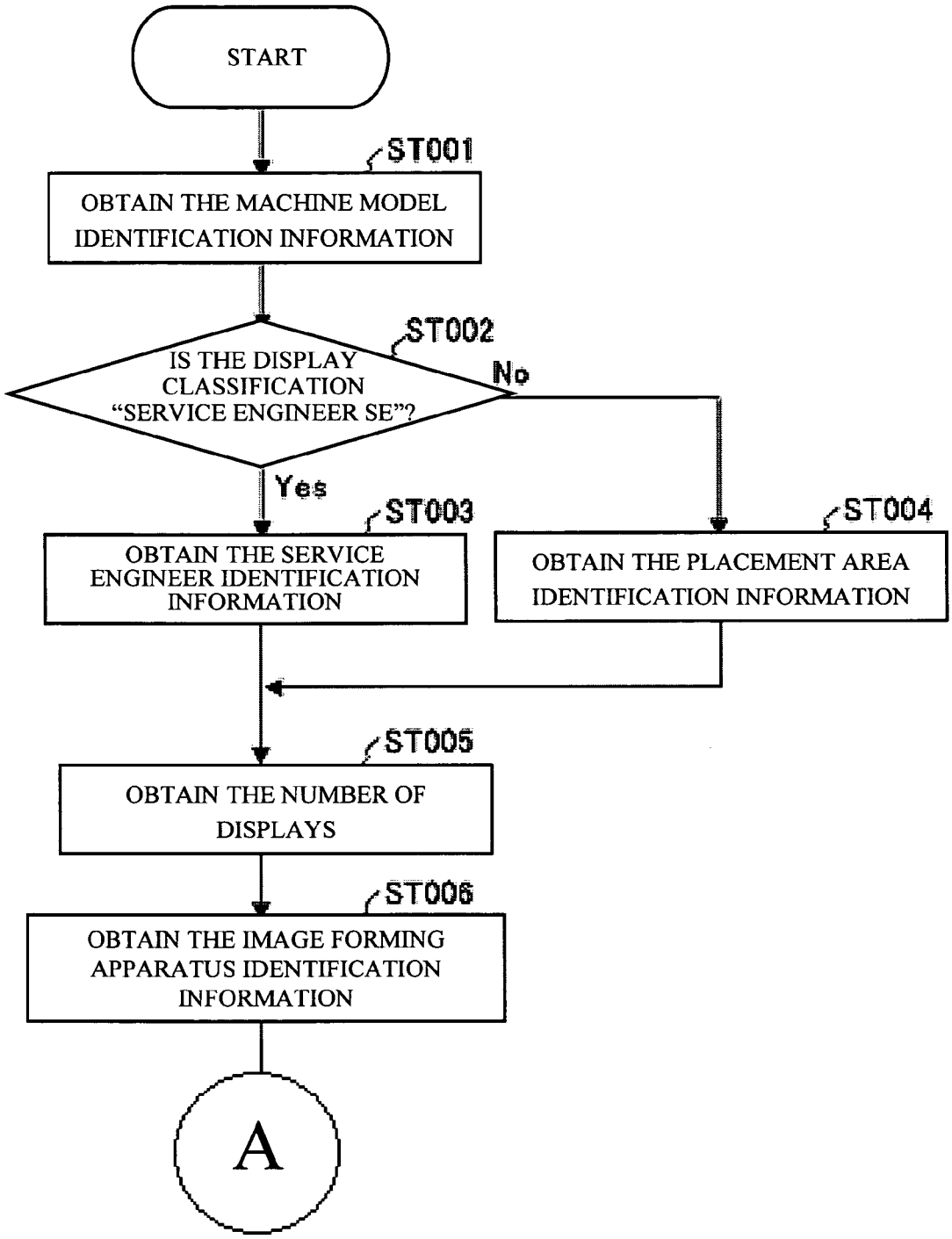
FIG. 13A and FIG. 13B show a flowchart of an example of a control operation to be performed by the controller in the failure prevention monitoring mode.
Figure 13B:
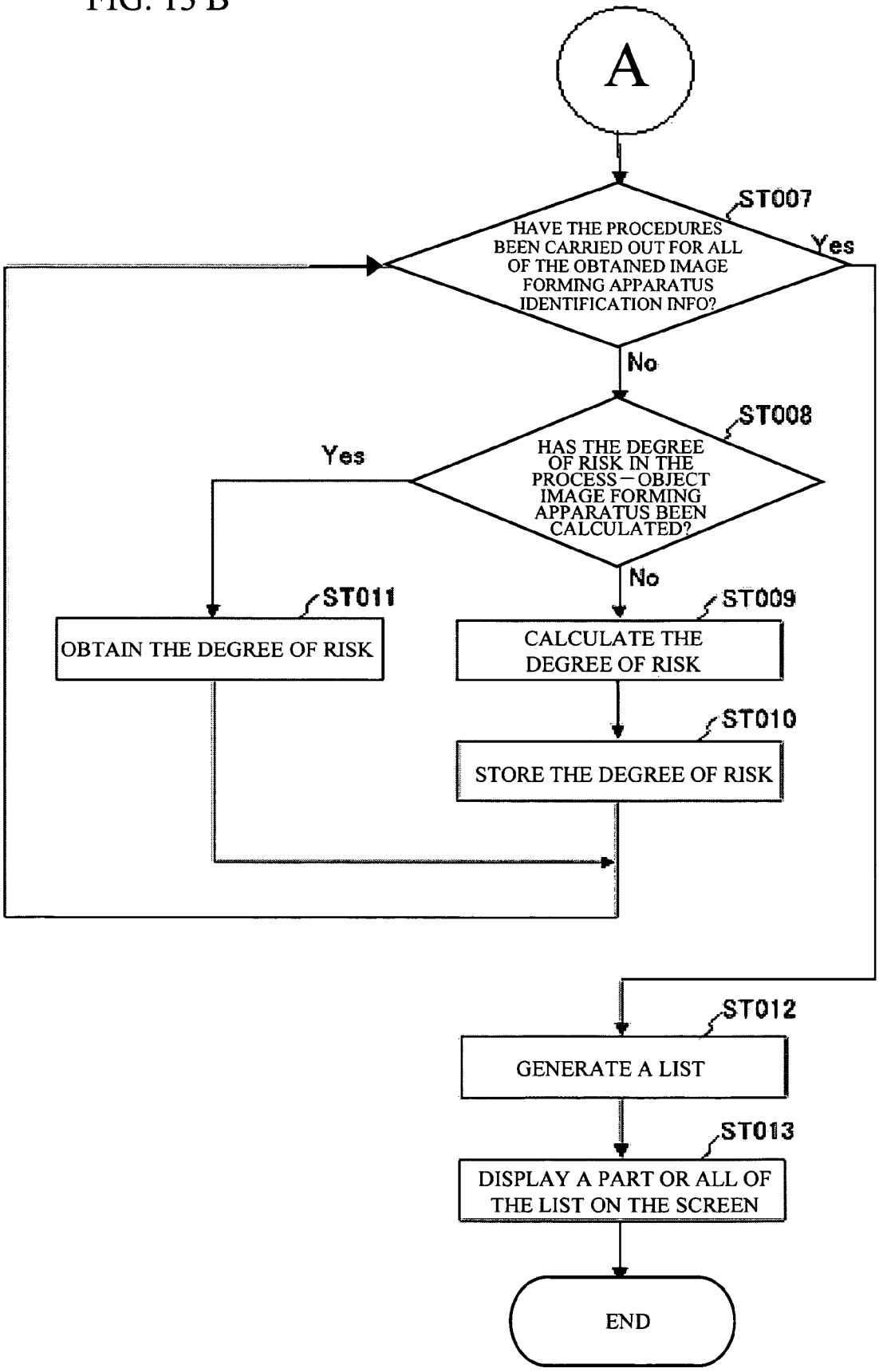

Referring now to FIG. 13A and FIG. 13B, a control operation to be performed by the controller 203 in the failure prevention monitoring mode is described. FIG. 13A and FIG. 13B show a flowchart of an example of the control operation to be performed by the controller 203 in the failure prevention monitoring mode.

First, the controller 203 obtains the machine model identification information about the image forming apparatuses 101 through 10m to be supported, from the input portion 205 or the like (step ST001).

The controller 203 determines whether the character string displayed in the display classification list box LBD in the first input code display region ACIL of the failure prevention monitor screen FPM displayed on the display 204 or the like is "service engineer SE" (step ST002). If the character string is "service engineer SE", the controller 203 moves on to step ST003, and if not, the controller 203 moves on to step ST004.

If the character string is determined to be "service engineer SE" in step ST002, the controller 203 obtains the service engineer identification information from the input portion 205 or the like (step ST003) The controller 203 then carries out the procedure of step ST005.

If the character string is determined not to be "service engineer SE" in step ST002, the controller 203 obtains the placement area identification information (ora territory code) from the input portion 205 or the like (step ST004). The controller 203 then carries out the procedure of step ST005.

After carrying out step ST003 or ST004, the controller 203 obtains the number of displays to be displayed in the display number list box LBV of the failure prevention monitor screen FPM displayed on the display 204 or the like (step ST005).

The controller 203 then obtains the image forming apparatus identification information associated with the machine model identification information obtained in step ST001 and the service engineer identification information obtained in step ST003 or the placement area identification information obtained in step ST004, with respect to the machine service table TMT stored in the memory 202 (step ST006). The controller 203 stores in a memory or the like the obtained image forming apparatus identification information and the placement area identification information associated with the image forming apparatus identification information in the machine service table TMT, with the two pieces of information being associated with each other in the memory or the like.

The controller 203 then determines whether the procedures of steps ST008 through ST011 have been carried out for all the image forming apparatus identification information obtained in step ST005 (step ST007). If the controller 203 determines that the procedures of steps ST008 through ST011 have been carried out for all the image forming apparatus identification information, the procedure of step ST012 is carried out next. If not, the procedure of step ST008 is carried out next.

If the controller 203 determines that the procedures of steps ST008 through ST011 have not been carried out for all the image forming apparatus identification information in step ST007, the controller 203 then carries out the procedures of steps ST008 through ST011 for one of the image forming apparatuses 101 through 10m identified by the image forming apparatus identification information for which the procedures have not been carried out.

In FIG. 13A and FIG. 13B, the image forming apparatus identification information for which the procedures are to be carried out is referred to simply as the processing image forming apparatus identification information, and the image forming apparatuses 101 through 10m identified by the processing image forming apparatus identification information is referred to simply as the processing image forming apparatuses.

The controller 203 next determines whether the chronological information table TH in the memory 202 stores the degree of risk associated with the process-object image forming apparatus identification information and the latest data collection date (step ST008). If the degree of risk has already been calculated in the past, the controller 203 moves on to step ST011, and if not, the controller 203 moves on to step ST009.

In FIG. 13A and FIG. 13B, the acquirement time (data collection date) that is nearest to the support date and not later than the support date determined from the system time is referred to simply as the latest data collection date.

If the controller 203 determines that the degree of risk has not been calculated in the past in step ST008, the controller 203 selects a logistic regression model from the memory 202 in accordance with the process-object image forming apparatus. More specifically, the controller 203 selects a logistic regression model, using one or more pieces of the machine model identification information (the machine model code) as to the process-object image forming apparatus, the placement area identification information (the territory code), and the service engineer identification information (the service engineer code).

The controller 203 then obtains the internal information associated with the process-object image forming apparatus identification information and the latest data collection date, and calculates the degree of risk as a predicted value of the selected regression model with the use of the logistic regression model selected in accordance with the obtained internal information (step ST009).

The calculated degree of risk and the total number of paper sheets fed on the latest data collection date are stored in a memory or the like, and are associated with the image forming apparatus identification information and the placement area identification information already stored in a memory or the like in association with each other.

With this structure, not only the degree of risk, which is the indicator of the degree of failure in the image forming apparatus, is calculated by the logistic regression model selected for each image forming apparatus, but also the degree of risk calculated by the logistic regression model belongs to a range that is determined by the value representing a normal state or the value representing a failed state. Accordingly, whether it is necessary to take measures for various image forming apparatuses can be determined with high precision by comparing the value obtained by dividing the difference between the normal value and the degree of risk by the range size with a predetermined reference value.

The controller 203 controls the program so that the degree of risk calculated in step ST009 is associated with the process-object image forming apparatus identification information and the latest data collection date and is stored in the chronological information table TH in the memory 202 (step ST010). The controller 203 then returns to step ST007 and repeats the above-described procedures.

If the controller 203 determines that the degree of risk has already been calculated in the past in step ST008, the controller 203 obtains the degree of risk associated with the process-object image forming apparatus identification information and the latest data collection date from the chronological information table TH in the memory 202 (step ST011).

As in step ST009, the obtained degree of risk and the total number of paper sheets fed on the latest data collection date are stored in a memory or the like, and are associated with the image forming apparatus identification information and the placement area identification information already stored in a memory or the like in association with each other. The controller 203 then returns to step ST007 and repeats the above-described procedures.

If the controller 203 determines that the procedures of steps ST008 through ST011 have been carried out for all the image forming apparatus identification information in step ST007, the controller 203 generates a list having items such as the process-object image forming apparatus identification information, the placement area identification information, the total number of fed paper sheets, and the degree of risk, which have been stored in association with one another in a memory or the like (step ST012). The items on the generated list are sorted in ascending order of the degree of risk.

The controller 203 then controls the display 204 or the like to collectively display the items of the list generated in step ST012 in the failure risk display region AR in descending order of priorities. Here, the number of items to be displayed in the failure risk display region AR is equal to the number of displays obtained in step ST005. The controller 203 also controls the display 204 or the like to display the machine model identification information obtained in step ST001, together the service engineer identification information obtained in step ST003 or the placement area identification information obtained in step ST004, in the first code display region ACO1. The controller 203 then ends the operation.

With this structure, the risk degrees in the image forming apparatuses, of which the person identified by the service engineer identification information is in charge, can be collectively displayed as a list. Accordingly, users can take measures against failure in the image forming apparatuses, or can instantly sense which image forming apparatus needs repair. Also, users can promptly grasp the priorities assigned to the image forming apparatuses for which measures against failure are to be taken in accordance with the risk degrees.

With this structure, the risk degrees in the image forming apparatuses placed in the area identified by the placement area identification information can be collectively displayed on a display device. Accordingly, users can take measures against failure in the image forming apparatuses, or can instantly sense which image forming apparatus needs repair. Also, users can promptly grasp the priorities assigned to the image forming apparatuses for which measures against failure are to be taken in accordance with the risk degrees. Thus, the work load and costs required for constantly checking the image forming apparatuses for the need of repair can be reduced.

The controller 203 further controls the display 204 to display a chronological chart produced by associating the risk degrees calculated through the control of a program or the like with the acquirement time information stored together with the internal information used for calculating the risk degrees in the memory 202.

Figure 14:
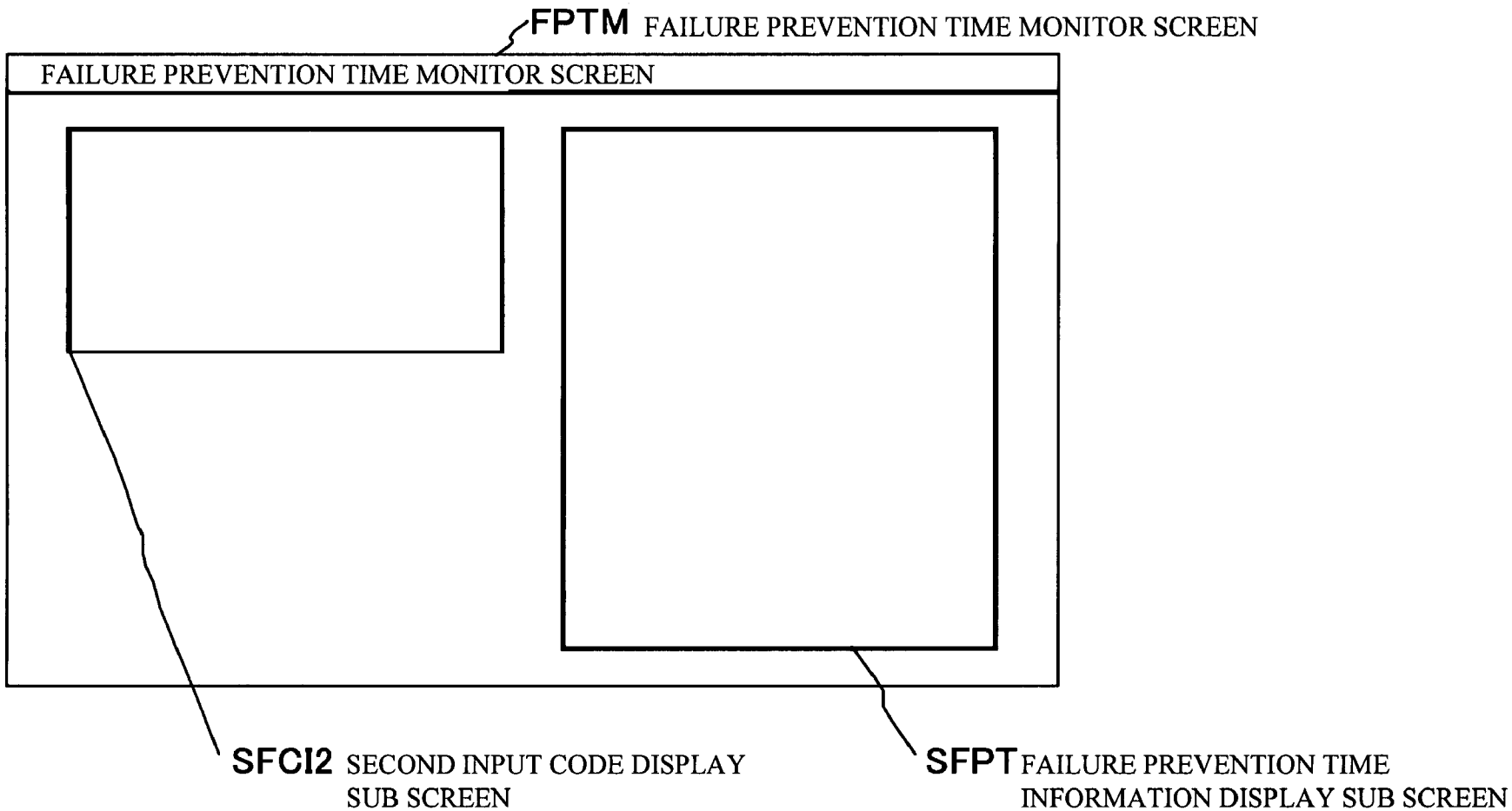
FIG. 14 shows an example of the failure prevention time monitor screen to be displayed on the display.

Referring now to FIG. 14, an example of a display screen displayed on the display 204 when the controller 203 controls the display 204 to collectively display the risk degrees and the image forming apparatus identification information associated with one another is described. FIG. 14 shows an example of a failure prevention time monitor screen displayed on the display 204 or the like.

The failure prevention time monitor screen FPTM shown in FIG. 14 is a screen for displaying the time course of the degree of risk in one image forming apparatus in the form of a chart.

The failure prevention time monitor screen FPTM is also a screen to be displayed on the display 204 or the like when a user operates the input portion 205 or the like to switch the operation mode of the failure prevention diagnosis support device 200 to a failure prevention time monitoring mode that is an operation mode for monitoring the image forming apparatus over time and preventing failures.

More specifically, a user touches the detailed information display button BTM of the failure prevention monitor screen FPM, so as to operate the input portion 205 or the like. The operated input portion 205 inputs an instruction to switch the operation mode to the failure prevention time monitoring mode.

The failure prevention time monitor screen FPTM has a second input code display sub screen SFCI2 and a failure prevention time information display sub screen SFPT.

Like the first input code display sub screen SFCI1 of the failure prevention monitoring screen FPM, the second input code display sub screen SFCI2 is a sub screen for displaying information that is input through the input portion 205 or the like so as to determine the image forming apparatus to be supported by the controller 203.

The failure prevention time information display sub screen SFPT is a sub screen for displaying information such as the degree of risk in the image forming apparatus designated by the information displayed on the second input code display sub screen SFCI2 and the information input through the input portion 205 or the like.

Figure 15:
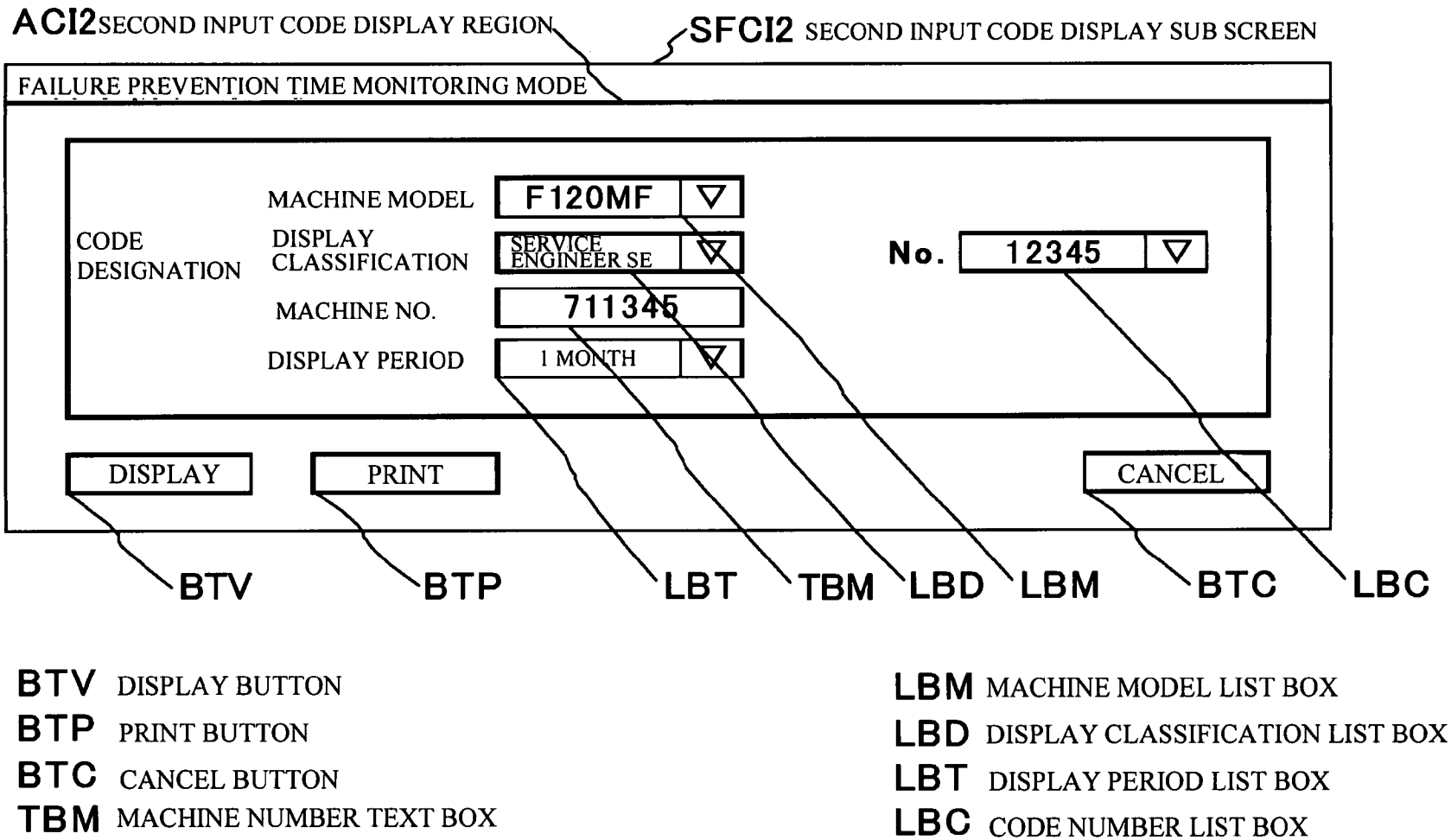
FIG. 15 shows an example of the second code input sub screen to be displayed on the display.

Referring now to FIG. 15, the second input code display sub screen SFCI2 is described. FIG. 15 shows an example of the second input code display sub screen SFCI2 to be displayed on the display 204 or the like.

The second input code display sub screen SFCI2 is formed with a second input code display region ACI2, a display button BTV, a print button BTP, and a cancel button BTC.

Like the first input code display region ACI1 of the first input code display sub screen SFCI1, the second input code display region ACI2 displays information that is input through the input portion 205 or the like.

Like the display button BTV of the first input code display sub screen SFCI1, the display button BTV shows that an instruction to start user support with the use of the information displayed in the second input code display region ACI2 can be input by a user touching the display button BTV and thus operating the input portion 205 or the like.

Like the print button BTP of the first input code display sub screen SFCI1, the print button BTP shows that an instruction to print out the support information displayed on the failure prevention time information display sub screen SFPT through a printer or the like provided in or connected to the failure prevention diagnosis support device 200, though not shown in the drawing, can be input by a user touching the print button BTP.

Like the cancel button BTC of the first input code display sub screen SFCIL, the cancel button BTC shows that an instruction to cancel the display on the failure prevention time monitor screen FPTM of FIG. 14 displayed in the failure prevention time monitoring mode, which is not the normal operation mode, and to display a screen of the normal operation mode, can be input by a user touching the cancel button BTC.

The second input code display region ACI2 includes a machine model list box LBM, a display classification list box LBD, a code number list box LBC, a machine number text box TBM, and a display period list box LBT.

The machine model list box LBM, the display classification list box LBD, and the code number list box LBC have the same functions as the machine model list box LBM, the display classification list box LBD, and the code number list box LBC of the first input code display sub screen SFCI1.

Like the machine model list box LBM and the others, the machine number text box TBM and the display period list box LBT also display information that is input by a user operating the input portion 205 or the like.

More specifically, the machine number text box TBM displays the image forming apparatus identification information.

The display period list box LBT shows the time period in the chart showing the time course of the degree of risk displayed on the failure prevention time information display sub screen SFPT. For example, if the display period list box LBT shows "1 month", the failure prevention time information display sub screen SFPT displays, as a chart, the time course of the degree of risk during the past one month from the support date.

Figure 16:
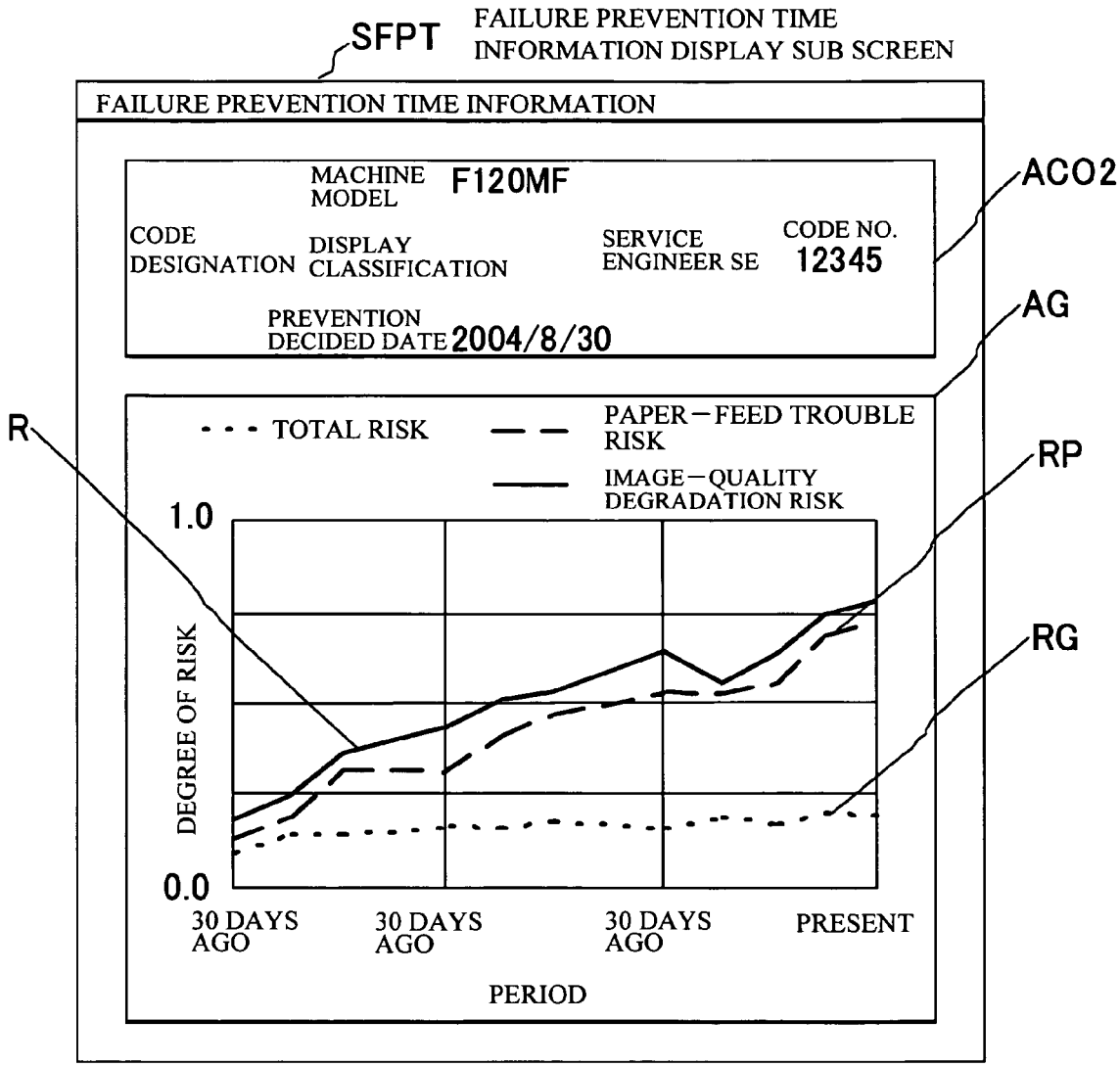
FIG. 16 shows an example of the failure prevention time information display sub screen to be displayed on the display.

Referring now to FIG. 16, the failure prevention time information display sub screen SFPT is described. FIG. 16 shows an example of the failure prevention time information display sub screen SFPT to be displayed on the display 204.

The failure prevention time information display sub screen SFPT has a second code display region ACO2 and a chart display region AG.

The second code display region ACO2 displays part of the information displayed on the second input code display sub screen SFCI2 and the support date. More specifically, the second code display region ACO2 displays the machine model identification information displayed in the machine model list box LBM of the second input code display sub screen SFCI2, the character string displayed in the display classification list box LBD, and the service engineer identification information or the placement area identification information displayed in the code number list box LBC.

The chart display region AG displays a line plot that represents the change in the degree of risk in the image forming apparatus identified by the image forming apparatus identification information displayed in the machine number text box TBM of the second input code display sub screen SFCI2.

In the line chart displayed in the chart display region AG, the abscissa axis indicates time, and the ordinate axis indicates the degree of risk.

On the abscissa axis, the date represented by the origin of the time axis is a date earlier than the support date by the time equivalent to the display period shown in the display period list box LBT of the second input code display sub screen SFCI2, and the support date is represented by the largest possible value that can be shown on the abscissa axis.

On the ordinate axis, the origin represents a normal state ("0" in this exemplary embodiment), and the largest possible value on the ordinate axis represents a failed state ("1" in this exemplary embodiment).

In the chart displayed in the chart display region AG, a paper-feed trouble risk curve RP that represents the change with time in the paper-feed trouble risk, an image-quality degradation risk curve RG that represents the change with time in the image-quality degradation risk, and a total risk curve (R) that represents the change with time in the total risk are displayed in an overlapping fashion.

Figure 17:
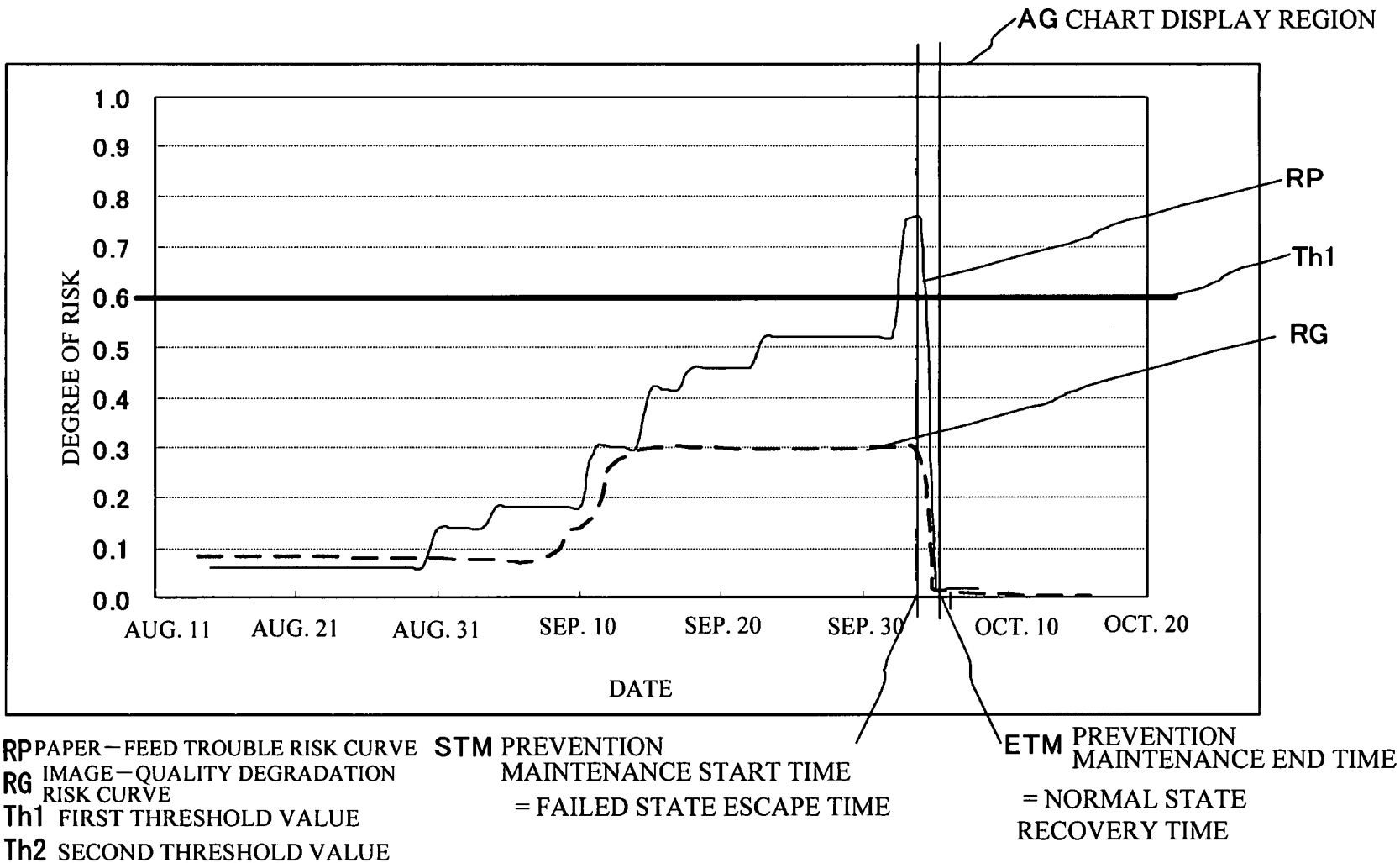
FIG. 17 shows an example of the chart display region to be displayed on the display.

Referring now to FIG. 17, the chart display region AG displayed on the display 204 or the like is described in detail. FIG. 17 shows an example of the chart display regionAG displayed on the display 204 or the like.

The graph display region AG shown in FIG. 17 displays a line that runs parallel to the time axis representing a predetermined threshold value Th1. In the graph display regionAG, the degree of risk that is a predicted value by a logistic regression model in accordance with the observed internal information, and the threshold value Th1 are displayed in an overlapping fashion.

With this chart structure, the person (user) in charge of maintenance of the image forming apparatuses 101 through 10m can determine that the image forming apparatuses need repair, when the paper-feed trouble risk curve RP or the image-quality degradation risk curve RG of the image forming apparatuses 101 through 10m managed by the person crosses the line representing the first threshold value Th1. Also, the person can determine whether there is a need of urgent repair, on the basis of the upward trend of the paper-feed trouble risk curve RP or the image-quality degradation risk curve RG.

In this structure, not only the degree of risk, which is the indicator of the degree of failure in the image forming apparatuses, is calculated by a logistic regression model selected for each image forming apparatus, but also the degree of risk calculated by the logistic regression model belongs to the range that is determined by the value representing a normal state and the value representing a failed state. Accordingly, whether it is necessary to take measures for various image forming apparatuses can be determined with high precision by comparing the value obtained by dividing the difference between the normal value and the degree of risk by the range size with a predetermined reference value.

Also, in this structure, the display displays a chronological chart showing the risk degrees associated with the acquirement time information. Accordingly, not only the risk degrees but also the increases and decreases in the risk over time can be promptly grasped. Thus, users can easily and efficiently determine whether there is an urgent need to take measures against failure or to repair the image forming apparatuses.

As can be seen from FIG. 17, the risk degrees keep dropping during the period that starts at a prevention maintenance start time STM and ends at a failure prevention maintenance end time ETM.

Figure 18A:
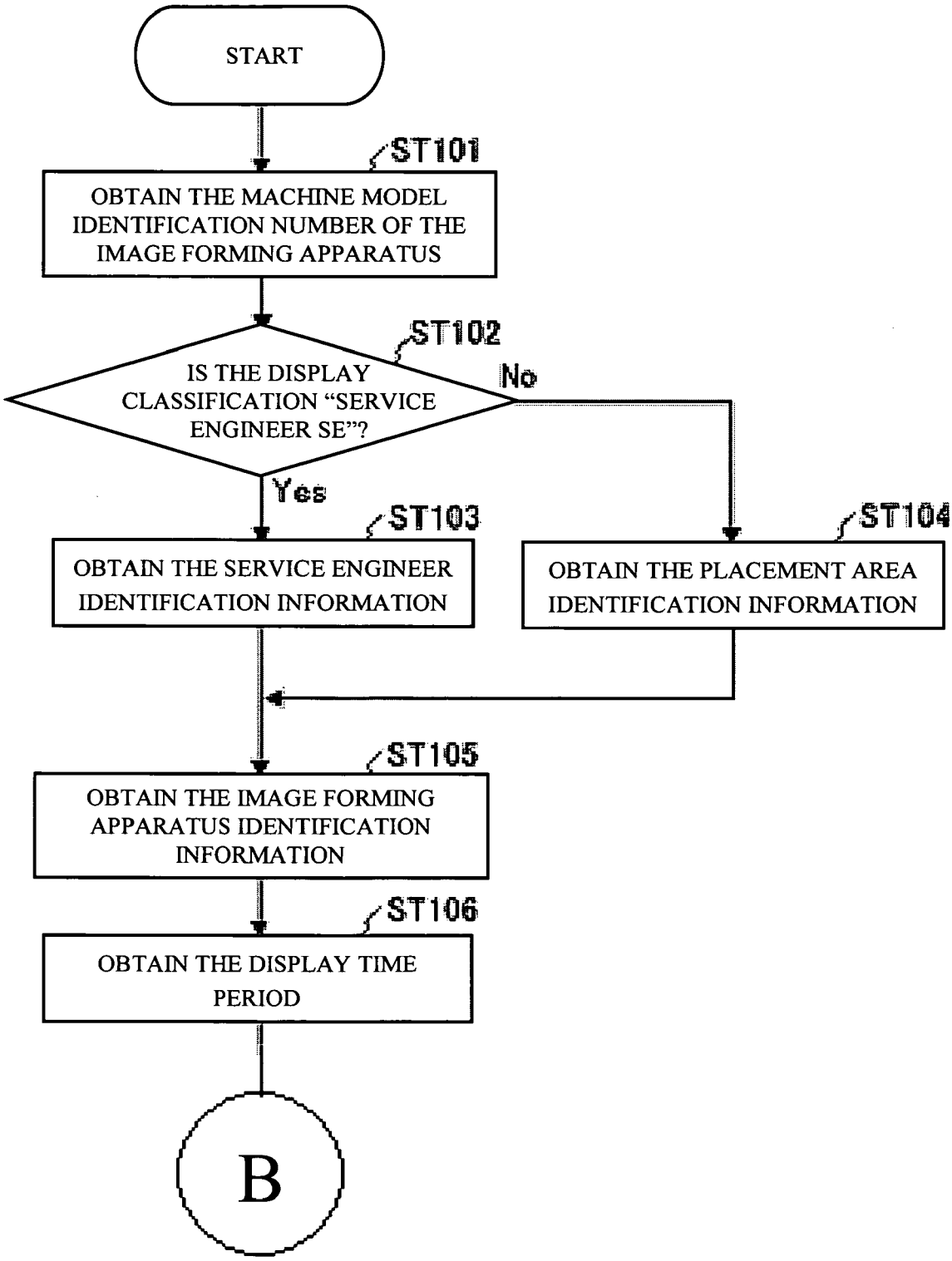
FIG. 18A and FIG. 18B show a flowchart of an example of a control operation to be performed by the controller in the failure prevention time monitoring mode.
Figure 18B:
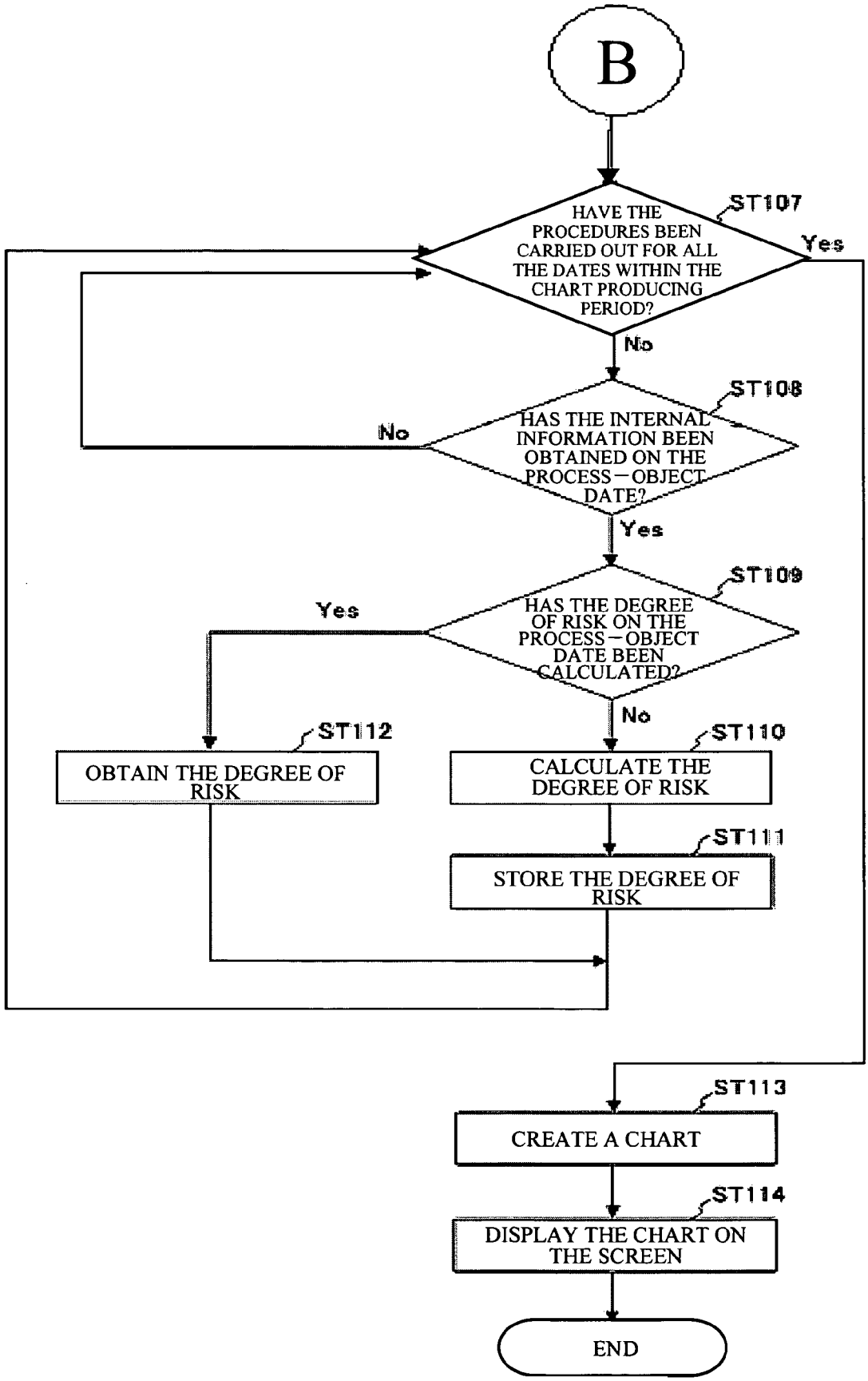

Referring now to FIG. 18A and FIG. 18B, a control operation to be performed by the controller 203 in the failure prevention time monitoring mode is described. FIG. 18A and FIG. 18B show a flowchart of an example of the control operation to be performed by the controller 203 in the failure prevention time monitoring mode.

First, the controller 203 carries out the procedures of steps ST101 through ST105. The procedures of steps ST101 through ST105 are the same as the procedures of steps ST001 through ST005 of FIG. 13A, and therefore, explanation of them is omitted herein. In FIG. 18A and FIG. 18B, the image forming apparatuses 101 through 10m that are identified by the image forming apparatus identification information obtained in step ST105 and are to be supported are referred to as the support-object image forming apparatuses.

The controller 203 then obtains the display period information displayed in the display period list box LBT of the failure prevention time monitor screen FPTM displayed on the display 204 or the like (step ST106).

The controller 203 obtains the support date from the system time. The controller 203 determines whether the procedures of steps ST108 through ST112 have been carried out for all the dates within the time range that starts from the date the display time period earlier than the obtained support date and ends on the support date (step ST107). If the procedures of steps ST108 through ST112 have been carried out for all the dates, the controller 203 moves on to step ST113, and, if not, the controller 203 moves on to step ST108.

If the controller 203 determines that the procedures of steps ST108 through ST112 have not been carried out for all the dates in step ST107, the controller 203 selects one of the dates for which the procedures have not been carried out, and sets the date as a process-object date.

The controller 203 also determines whether the internal information associated with the process-object date and the image forming apparatus identification information obtained in step ST105 exists in the chronological information table TH in the memory 202.

In short, the controller 203 determines whether the internal information has been obtained on the process-object date (step ST108). If the internal information has been obtained on the process-object date, the controller 203 moves on to step ST109, and, if not, the controller 203 returns to step ST107 and repeats the above-described procedures.

If the controller 203 determines that the internal information has been obtained on the process-object date in step ST108, the controller 203 then determines whether the chronological information table TH stores the degree of risk associated with the process-object date and the image forming apparatus identification information obtained in step ST105.

In short, the controller 203 determines whether the degree of risk has already been calculated based on the internal information obtained on the process-object date (step ST109) If the degree of risk has already been calculated based on the internal information obtained on the process-object date, the controller 203 moves on to step ST112, and, if not, the controller 203 moves on to step ST110.

If the controller 203 determines that the degree of risk has not been calculated in step ST109, the controller 203 selects a logistic regression model from the memory 202 in accordance with the support-object image forming apparatus. More specifically, the controller 203 selects a logistic regression model, on the basis of one or more pieces of the machine model identification information (the machine model code) of the support-object image forming apparatus, the placement area identification information (the territory code), and the service engineer identification information (the service engineer SE code).

The controller 203 then obtains the internal information associated with the image forming apparatus identification information as to the support-object image forming apparatus and the process-object date, and calculates the degree of risk with the use of the logistic regression model selected in accordance with the obtained internal information (step ST110) The calculated degree of risk is stored together with the process-object date in a memory or the like.

The controller 203 then controls the program so as to store the degree of risk calculated in step ST110 associated with the image forming apparatus identification information as to the support-object image forming apparatus and the process-object date in the chronological information table TH in the memory 202 (step ST111). The controller 203 then returns to step ST107 and repeats the above-described procedures.

If the controller 203 determines that the degree of risk has already been calculated in the past in step ST109, the controller 203 obtains the degree of risk associated with the identification information identifying the support-object image forming apparatus and the process-object date from the chronological information table TH in the memory 202 (step ST112) The obtained degree of risk is stored together with the process-object date in a memory or the like. The controller 203 then returns to step ST107 and repeats the above-described procedures.

If the controller 203 determines that the procedures of steps ST108 through ST112 have been carried out for all the process-object dates in step ST107, the controller 203 creates a chart that shows the change in the degree of risk over time, based on the risk degrees obtained or calculated and stored with the object-process dates (step ST113).

The controller 203 then controls the display 204 or the like to display the chart created in step ST113 in the chart display region AG (step ST114). The controller 203 also controls the display 204 or the like to display the machine model identification information obtained in step ST101, together with the service engineer identification information obtained in step ST103 or the placement area identification information obtained in step ST104, in the second code display region ACO2. The controller 203 then ends the operation.

The controller 203 further obtains the internal information that is associated with the image forming apparatus identification information input through the input portion 205 or the like. Based on the obtained internal information, the controller 203 controls the failure diagnosis portion 206 to calculate the failure occurrence probability in the component or the set of components that have caused a failure in the image forming apparatus identified by the image forming apparatus identification information. The controller 203 then controls the display 204 to collectively display the failure cause occurrence probability calculated by the failure diagnosis portion 206 associated with the component or the set of components in which the cause of the failure is found.

Figure 19:
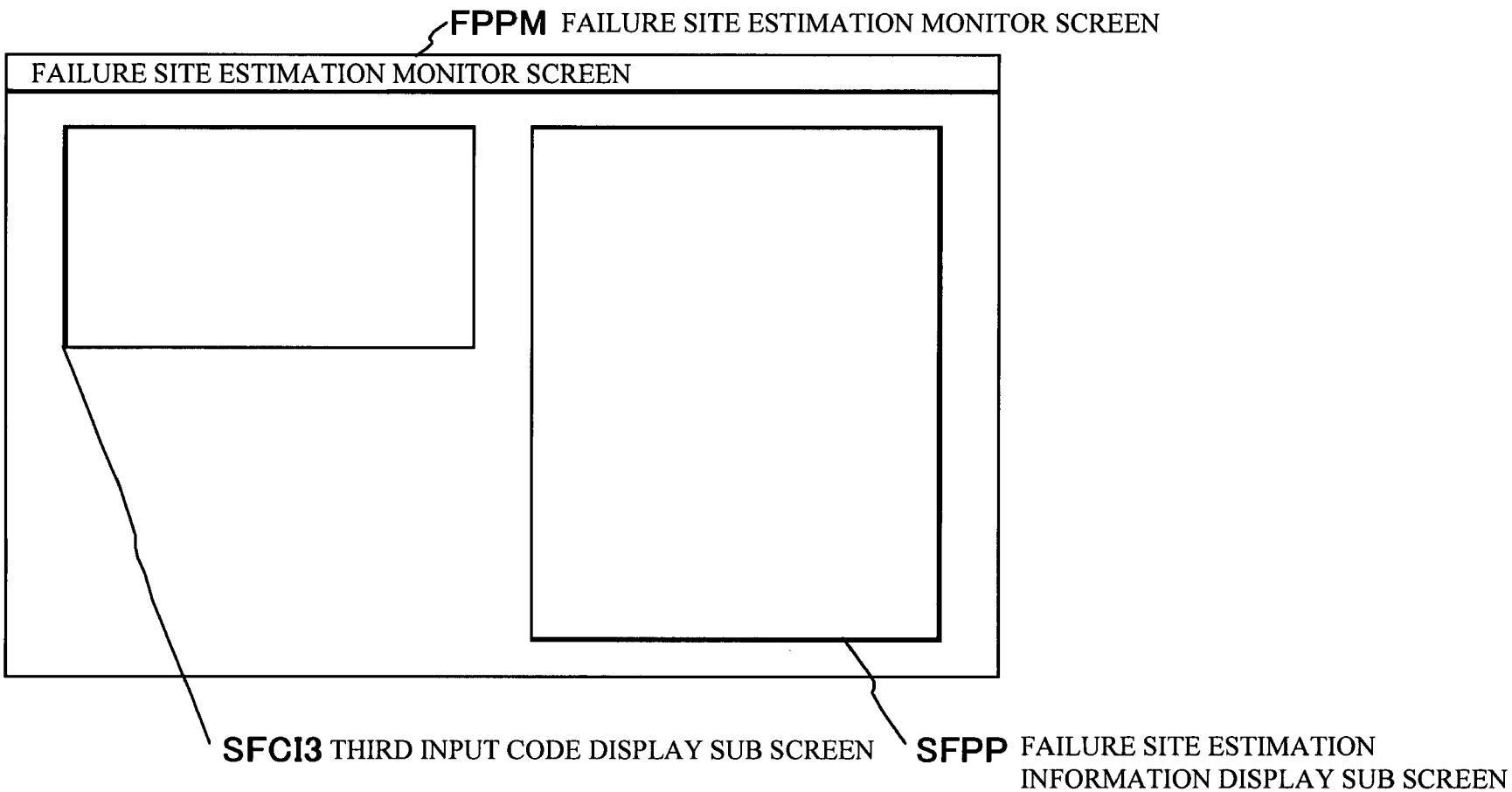
FIG. 19 shows an example of the failure site estimation monitor screen to be displayed on the display.

Referring now to FIG. 19, an example of a display screen to be displayed on the display 204 when the controller 203 controls the display 204 to collectively display the failure cause occurrence probabilities and the failure cause occurrence sites is described. FIG. 19 shows an example of the failure site estimation monitor screen to be displayed on the display 204 or the like.

The failure site estimation monitor screen FPPM shown in FIG. 19 is a screen for displaying the failure probabilities in the components forming a designated image forming apparatus.

The failure site estimation monitor screen FPPM is also a screen to be displayed on the display 204 or the like when a user operates the input portion 205 or the like to switch the operation mode of the failure prevention diagnosis support device 200 from the normal operation mode to a failure site estimation monitoring mode that is an operation mode for estimating a failure site in the image forming apparatus.

The failure site estimation monitor screen FPPM has a third input code display sub screen SFCI3 and a failure site estimation information display sub screen SFPP.

Like the first input code display sub screen SFCI1 of the failure prevention monitoring screen FPM, the third input code display sub screen SFCI3 is a sub screen for displaying information that is input through the input portion 205 or the like so as to determine the image forming apparatus to be supported by the controller 203.

The failure site estimation information display sub screen SFPP is a sub screen for collectively displaying information such as the risk degrees, the failure probabilities, and the failure sites in the image forming apparatuses 101 through 10m designated by the information displayed on the third input code display sub screen SFCI3 and the information input through the input portion 205 or the like.

Figure 20:
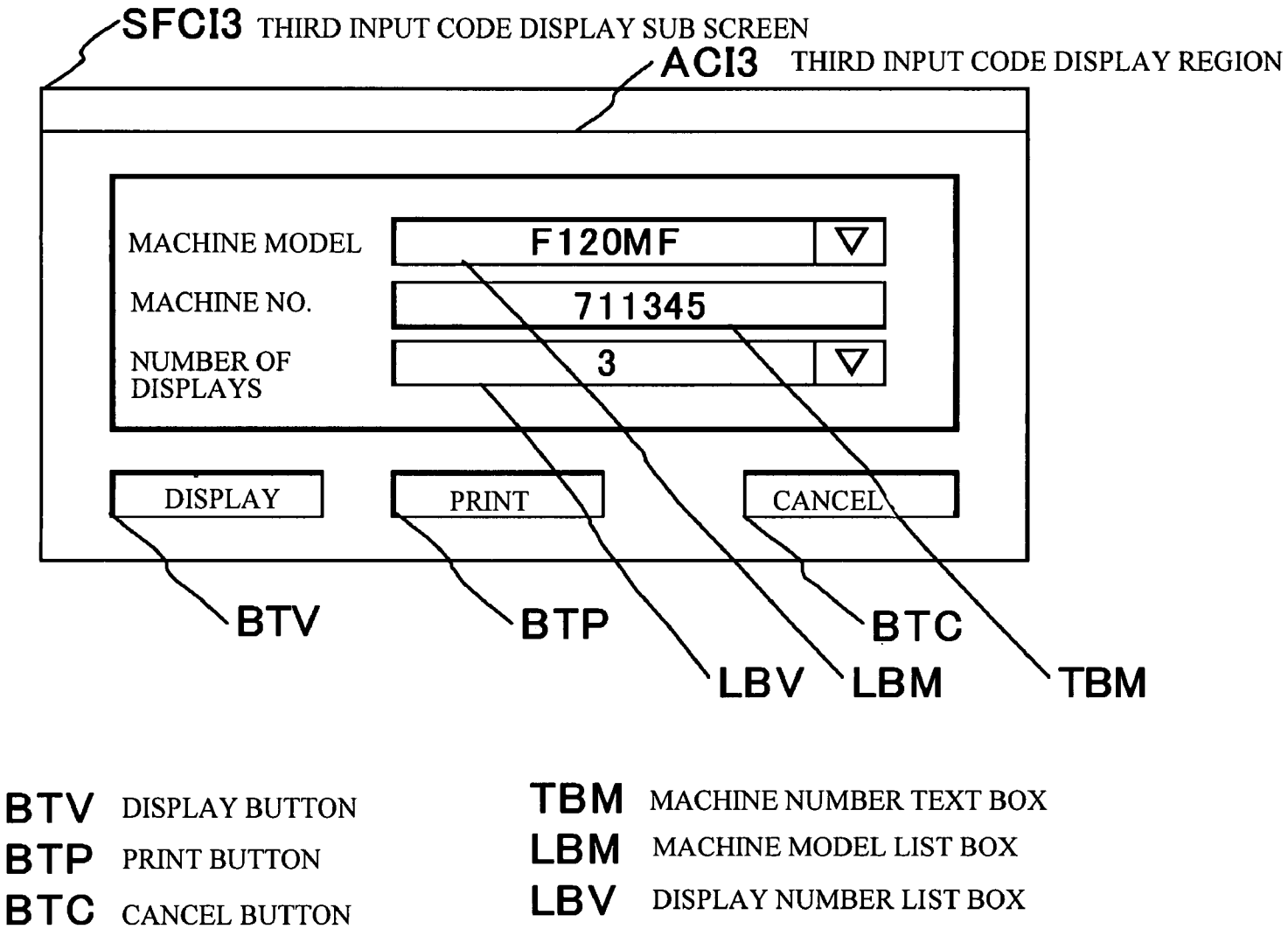
FIG. 20 shows an example of the third code input sub screen to be displayed on the display.

Referring now to FIG. 20, the third input code display sub screen SFCI3 is described. FIG. 20 shows an example of the third input code display sub screen SFCI3 to be displayed on the display 204 or the like.

The third input code display sub screen SFCI3 is formed with a third input code display region ACI3, a display button BTV, a print button BTP, and a cancel button BTC.

Like the first input code display region ACI of the first input code display sub screen SFCI1, the third input code display region ACI3 displays information that is input through the input portion 205 or the like.

The display button BTV shows that an instruction to start user support with the use of the information displayed in the third input code display region ACI3 can be input by a user touching the display button BTV and thus operating the input portion 205 or the like.

Like the print button BTP of the first input code display sub screen SFCI1, the print button BTP shows that an instruction to print out the support information displayed on the failure site estimation information display sub screen SFPP through a printer or the like provided in or connected to the failure prevention diagnosis support device 200, though not shown in the drawing, can be input by a user touching the print button BTP.

Like the cancel button BTC of the first input code display sub screen SFCI1, the cancel button BTC shows that an instruction to cancel the display on the failure site estimation monitor screen FPPM of FIG. 19 displayed in the failure site estimation monitoring mode, which is not the normal operation mode, and to display a screen of the normal operation mode, can be input by a user touching the cancel button BTC.

The third input code display region ACI3 includes a machine model list box LBM, a machine number text box TBM, and a display number list box LBV.

The machine model list box LBM and the machine number text box TBM have the same functions as the machine model list box LBM and the machine number text box TBM of the second input code display sub screen SFCI2.

The display number list box LBV displays information that is input by a user operating the input portion 205 or the like. More specifically, the display number list box LBV displays the maximum number of failures probabilities in sites to be displayed at the same time on the failure site estimation information display sub screen SFPP.

Figure 21:
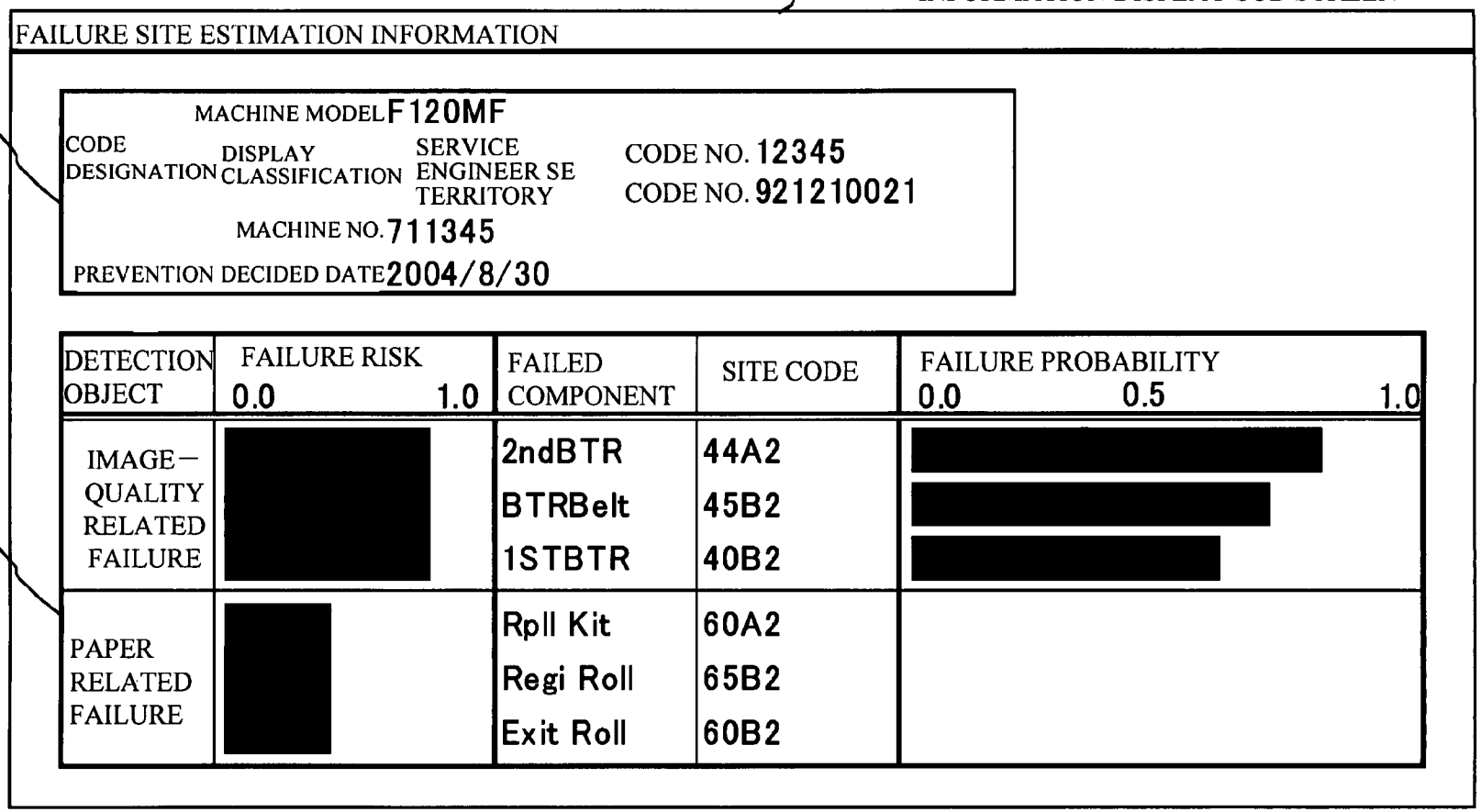
FIG. 21 shows an example of the failure site estimation information display sub screen to be displayed on the display.

Referring now to FIG. 21, the failure site estimation information display sub screen SFPP is described. FIG. 21 shows an example of the failure site estimation information display sub screen SFPP to be displayed on the display 204 or the like.

The failure site estimation information display sub screen SFPP has a third code display region ACO3 and a component failure probability display region ARP.

The third code display region ACO3 displays part of the information displayed on the third input code display sub screen SFCI3 and the support date. More specifically, the third code display region AC03 displays the machine model identification information displayed in the machine model list box LBM of the third input code display sub screen SFCI3, the image forming apparatus identification information displayed in the machine number text box TBM, and the support date.

The third code display region ACO3 also displays the service engineer identification information and the placement area identification information as to the image forming apparatuses 101 through 10m identified by the image forming apparatus identification information displayed in the machine number text box TBM. Here, the service engineer identification information and the placement area identification information are displayed as "service engineer code No." and "territory code No.".

The component failure probability display region ARP displays the failure risk degrees and failed components that are classified into image-related failures and paper-related failures to be diagnosed. Each failure risk degree is displayed on the same line as the corresponding failed component, so that the failure risk degrees are associated with the respective failed components. The component failure probability display region ARP also displays the area codes of the failed components and the failure probabilities. Each area code and each corresponding failure probability are displayed on the same line as the corresponding failed component, so that the area codes and the failure probabilities can be associated with the respective failed components.

Each object to be diagnosed is an image-related failure or a paper-related failure. An image-related failure is a failure that causes image quality deterioration. A paper-related failure is a failure that causes a paper jam.

In FIG. 21, the failure risk degrees are image-quality degradation risks and paper-feed trouble risks. More specifically, a failure risk degree is an image-quality degradation risk in a case where the object to be diagnosed is an image-related failure. A failure risk degree is a paper-feed trouble risk in a case where the object to be diagnosed is a paper-related failure.

The failed components are the components or the sets of components that constitute the image forming apparatuses 101 through 10m, and supposedly have failures. Each component that causes image quality degradation through a failure is associated with an image-related failure, while each component that causes a paper jam through a failure is associated with a paper-related failure. Each component that causes image quality degradation and a paper jam through a failure is associated with both an image-related failure and a paper-related failure.

In the component failure probability display region ARP, the components associated with the image-related failures and/or the paper-related failures are displayed in descending order based on the failure probabilities estimated by the controller 203 as described later. Here, the number of components displayed here is not larger than the number shown in the display number list box LBV of the third input code display region ACI3.

The area codes are the information for identifying the sites or regions in which the failed components are located in the image forming apparatuses 101 through 10m.

The failure probabilities are calculated by the controller 203 and indicate the probabilities that the respective failed components actually have failures, as described later.

Figure 22A:
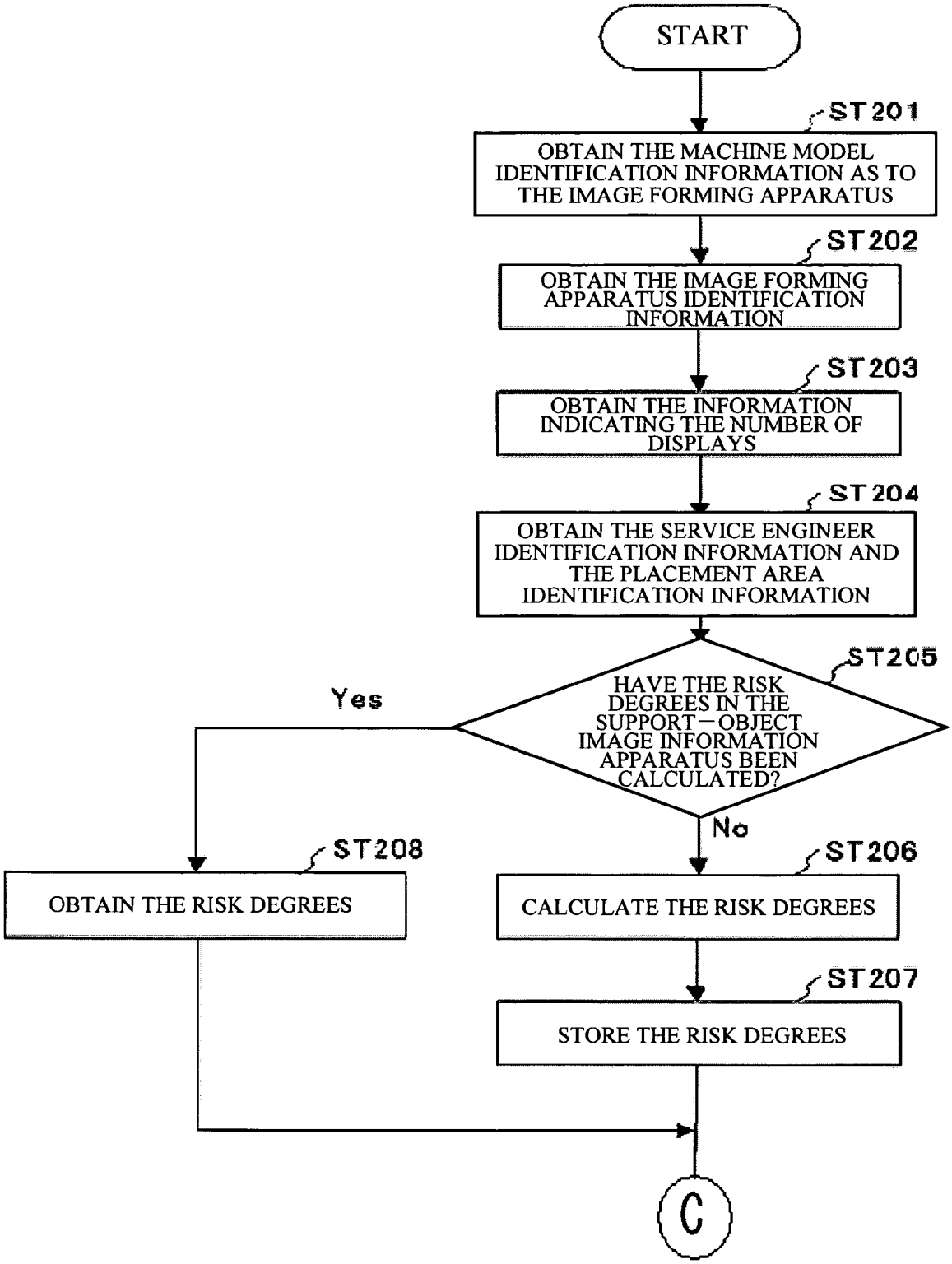
FIG. 22A and FIG. 22B show a flowchart of an example of a control operation to be performed by the controller in the failure site estimation monitoring mode.
Figure 22B:
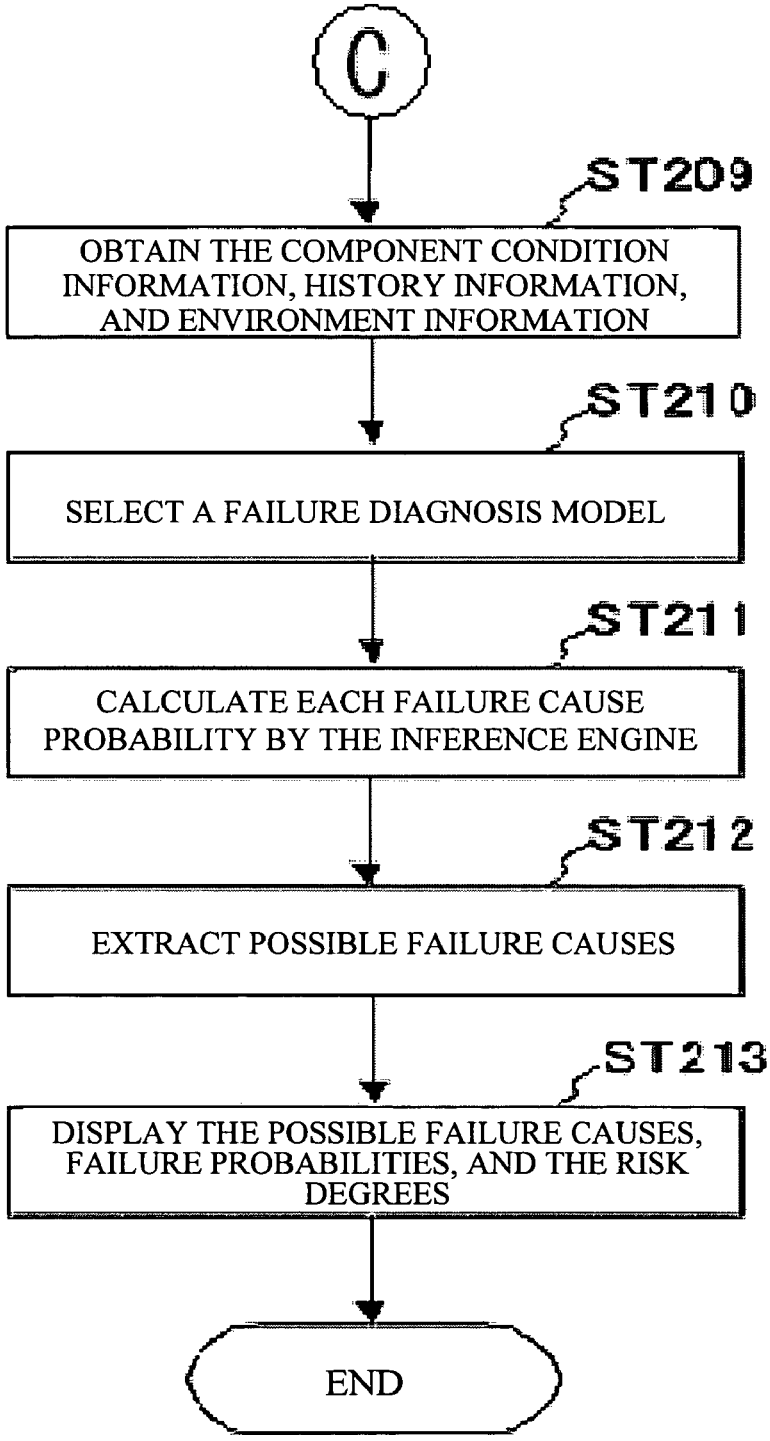

Referring now to FIG. 22A and FIG. 22B, a control operation to be performed by the controller 203 in the failure site estimation monitoring mode is described. FIG. 22A and FIG. 22B show a flowchart of an example of the control operation to be performed by the controller 203 in the failure site estimation monitoring mode.

First, the controller 203 obtains the machine model identification information about the image forming apparatuses 101 through 10m to be supported, from the input portion 205 or the like (step ST201).

The controller 203 then obtains the image forming apparatus identification information about the image forming apparatuses 101 through 10m to be supported, from the input portion 205 or the like (step ST202). In FIG. 22A and FIG. 22B, the image forming apparatuses 101 through 10m identified by the image forming apparatus identification information obtained in step ST202 are referred to as the support-object image forming apparatuses.

The controller 203 then obtains the information as to the number of displays shown in the display number list box LBV displayed in the third input code display region ACI3 of the failure site estimation monitor screen FPPM displayed on the display 204 or the like (step ST203).

The controller 203 next obtains the service engineer identification information and the placement area identification information associated with the image forming apparatus identification information obtained in step ST202, from the machine service table TMT in the memory 202 (step ST204).

The controller 203 then determines whether the chronological information table TH in the memory 202 stores the image-quality degradation risk and the paper-feed trouble risk associated with the image forming apparatus identification information obtained in step ST202 and the latest data collection date (step ST205). In a case where the image-quality degradation risk and the paper-feed trouble risk are stored in the memory 202, or where the image-quality degradation risk and the paper-feed trouble risk have already been calculated, the controller 203 moves on to step ST208. In a case where the image-quality degradation risk and the paper-feed trouble risk have not been calculated, the controller 203 moves on to step ST206.

If the controller 203 determines that the image-quality degradation risk and the paper-feed trouble risk have already been calculated in the past in step ST205, the controller 203 carries out the same procedure as that of step ST011 of FIG. 13B (step ST208). The controller 203 then moves on to step ST209.

If the controller 203 determines that the image-quality degradation risk and the paper-feed trouble risk have not been calculated in step ST205, the controller 203 carries out the same procedures as those of steps ST009 and ST010 of FIG. 13A and FIG. 13B (steps ST206 and ST207). The controller 203 then moves on to step ST209.

After carrying out the procedure of step ST207 or ST208, the controller 203 controls the failure diagnosis portion 206 to obtain the internal information and the environment information that are associated with the image forming apparatus identification information obtained in step ST202 and the latest data collection date in the chronological information table TH in the memory 202. More specifically, the controller 203 controls the component condition information acquiring portion 2061 to obtain the component condition information based on the obtained internal information, controls the history information acquiring portion 2062 to obtain the history information, and controls the environment information acquiring portion 2063 to obtain the environment information (step ST209).

The controller 203 then selects a failure diagnosis model 20643, based on one or more pieces of the machine model identification information as to the image forming apparatuses 101 through 10m, the placement area identification information, and the information indicating whether the failure is an image-related failure or a paper-related failure (step ST210). The controller 203 then controls the failure probability inference portion 207 to calculate the failure occurrence probability for each of the components forming the image forming apparatuses 101 through 10m, with the use of the component condition information, the history information, and the environment information obtained in step ST209, and the failure diagnosis model 20643 selected in step S210 (step ST211).

The controller 203 next controls the possible failure detecting portion 20641 to extract possible failure causes in descending order with respect to the failure probabilities calculated for each image-related failure or each paper-related failure. The number of possible failure causes extracted here is equivalent to the information as to the number of displays obtained in step ST203 (step ST212).

The controller 203 then controls the display 204 or the like to display the machine identification information, the image forming apparatus identification information, the information as to the number of displays, the service engineer identification information, and the placement area identification information that are obtained in steps ST201 through ST204, the risk degrees obtained or calculated in step ST206 or ST208, and the possible failure causes and the failure probabilities extracted in step ST212 (step ST213). The controller 203 then ends the operation.

In this structure, the display displays the occurrence probabilities of failure causes in image forming apparatuses, together with components or sets of components that are the failure cause occurrence sites. Accordingly, the cause of each failure in the image forming apparatuses can be easily and efficiently determined.

The controller 203 further performs a control operation so as to update the logistic regression models stored in the memory 202, based on the internal information associated with the prevention maintenance start time STM, which is stored in the memory 202 and indicates the time immediately before the image forming apparatuses 101 through 10m are repaired, and the internal information associated with the prevention maintenance end time ETM, which indicates the time immediately after the repair.

Figure 23:
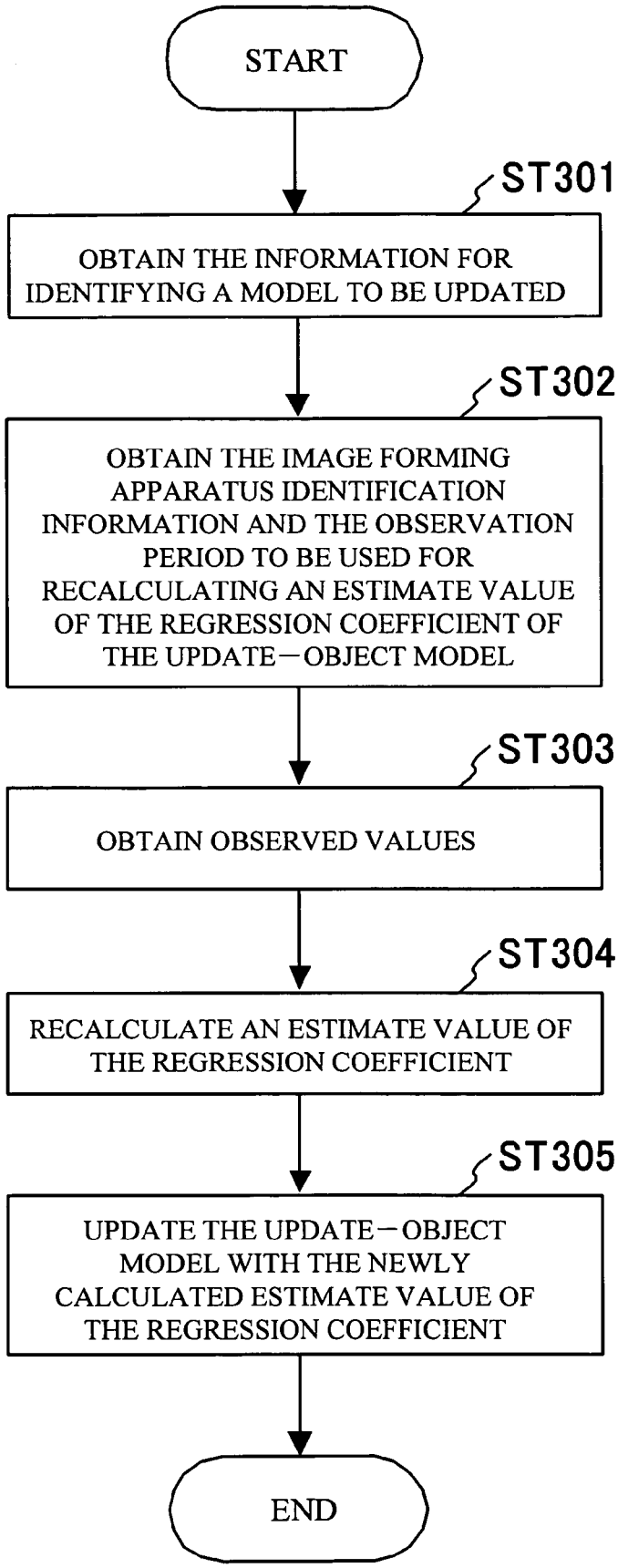
FIG. 23 shows an example of a control operation to be performed by the controller to update a logistic regression model.

Referring now to FIG. 23, a control operation to be performed by the controller 203 to update a logistic regression model is described. FIG. 23 shows an example of the control operation to be performed by the controller 203 to update a logistic regression model.

First, the controller 203 obtains information for identifying a logistic regression model to be updated (hereinafter referred to simply as the update-object model) from the input portion 205 or the like (step ST301).

The controller 203 then obtains the image forming apparatus identification information and an observation period that are to be used for recalculating an estimate value of the regression coefficient of the update-object model (step ST302).

The observation period may be preset for each logistic regression model or may be input by a user operating the input portion or the like.

For example, in a case where the update-object model is a model to be used for calculating the risk degrees in the image forming apparatuses 101 through 10m identified by the same placement area identification information, the controller 203 obtains the image forming apparatus identification information about the one or more image forming apparatuses 101 through 10m identified by the same placement area identification information stored in the machine service table TMT in the memory 202.

Since a decrease in humidity affects the properties of paper, the paper jam occurrence frequency is varied not depending on the internal states of the image forming apparatuses, for example.

Accordingly, this structure can cope flexibly with changes in the environment in which the image forming apparatuses are placed. Thus, the risk degrees can be calculated with high precision.

In a case where the update-object model is a model to be used for calculating the failure risk degrees in the image forming apparatuses identified by the same machine model identification information, for example, the controller 203 obtains the image forming apparatus identification information about the one or more image forming apparatuses 101 through 10m identified by the same machine model identification information stored in the machine service table TMT in the memory 202.

The controller 203 then obtains observed values from the chronological information table TH in the memory 202 (step ST303).

More specifically, the observed values obtained by the controller 203 include the internal information that is stored in the chronological information table TH in the memory 202, is associated with the image forming apparatus identification information obtained in step ST301, and is collected at the prevention maintenance start time STM or at the prevention maintenance end time ETM falling in the observation period obtained in step ST302, and a value indicating that the subject image forming apparatus is in a normal state and a value indicating that the subject image forming apparatus is in a failed state.

The controller 203 then assigns the internal information obtained as an observed value in step ST303 to the explanatory variables. The controller 203 also assigns the values indicating a failed state and a normal state of the image forming apparatus, which are also obtained as observed values in step ST303, to the objective variable. In this manner, the controller 203 calculates a new estimate value of the regression coefficient (step ST304).

The controller 203 then updates the update-object model stored in the memory 202, using the estimate value of the regression coefficient newly calculated in step ST304 (step ST305). The controller 203 then ends the operation.

In general, the degree of failure in an image forming apparatus before repair indicates the need of repair. The degree of failure in an image forming apparatus after repair indicates that there is no need of repair and the image forming apparatus is in a normal state. Accordingly, this structure can update models on the basis of the internal information that is stored in the memory 202 and represents the past failures. Thus, the risk degrees can be calculated with high precision.

Referring back to FIG. 1, explanation of an example of the failure prevention diagnosis support system 10 is continued.

The network 300 may be formed with a LAN, a WAN, or the Internet, for example. The network 300 is connected to the one or more image forming apparatuses 101 through 10m, the failure prevention diagnosis support device 200, and the remote terminals 401 through 40n.

The remote terminals 401 through 40n may be formed with PDAs (Personal Digital Assistants), notebook computers, or portable telephones, for example. Although not shown in FIG. 1, the remote terminals 401 through 40n each include a display and an input portion having the same functions and structures as the display 204 and the input portion 205 shown in FIG. 2.

The remote terminals 401 through 40n are connected to the network 300. The remote terminals 401 through 40n transmit the service engineer identification information, placement area identification information, image forming apparatus identification information, and machine model identification information that are input through the input portions of the remote terminals 401 through 40n via the network 300, together with various instructions, to the failure prevention diagnosis support device 200. The remote terminals 401 through 40n receive information transmitted from the failure prevention diagnosis support device 200, and display the received information on the displays of the remote terminals 401 through 40n.

In this structure, the information for identifying each image forming apparatus to be supported is input through the input portion, and the risk degrees in each image forming apparatus identified by the input information are displayed on the display of each terminal device. Thus, a failure prevention diagnosis system having a higher level of convenience can be produced.

The failure prevention diagnosis support method of the present invention can be realized with the failure prevention diagnosis support device 200.

In the above-described exemplary embodiments, the objective variable of each logistic regression model is a binary variable that is "0" in a normal state and is "1" in a failed state. However, the objective variable is not limited to that, and may be a binary variable that takes any constant value, as long as a normal state and a failed state are represented by different values.

In the above-described exemplary embodiments, the risk degrees and the constant threshold value Th1 are displayed in an overlapping fashion, as shown in FIG. 17, so as to support users. However, the present invention is not limited to that structure, and may provide a user support structure in which the risk degrees and value ranges are displayed in an overlapping fashion. More specifically, the risk degrees and three value ranges (a range of 0 to 0.5, a range of 0.5 to 0.7, and a range of 0.7 to 1.0) may be displayed in an overlapping fashion. When the degree of risk is 0.5 or lower, the display indicates that there is no need of maintenance. When the degree of risk is higher than 0.5 but lower than 0.7, the display displays a warning to draw the user's attention to changes in the degree of risk. When the degree of risk is 0.7 or higher, the display displays a warning that maintenance is urgently required. Further, it is also possible to provide a structure in which the threshold value Th1 and the value zones are variable.

In the above-described exemplary embodiments, the display period is set as one month, as shown in FIG. 15. However, the display period is not necessarily one month, but may also be two weeks, three months, or any other desired time period.

A failure prevention diagnosis support method employed according to an aspect of the present invention is accomplished with a Central Processing Portion (CPU), Read Only Memory (ROM), Random Access Memory (RAM), and the like, by installing a program from a portable memory device or a storage device such as a hard disc device, CD-ROM, DVD, or a flexible disc or downloading the program through a communications line. Then the steps of program are executed as the CPU operates the program.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A failure prevention diagnosis support system comprising:

an acquiring portion that acquires internal information about an internal state of an image forming apparatus;

a storage portion that stores one or a plurality of logistic regression models that define an estimate value of a regression coefficient through a logistic regression analysis using the internal information obtained when the image forming apparatus is in a failed state and in a normal state, the one or the plurality of logistic regression models having an objective variable that is a binary variable representing one of a failed state and a normal state of the image forming apparatus, the one or the plurality of logistic regression models having an explanatory variable that is the internal information about the image forming apparatus or a value obtained from the internal information; and a controller that performs a control operation to select a logistic regression model from the one or the plurality of the logistic regression models stored in the storage portion in accordance with the image forming apparatus, and to calculate risk degrees as objective variables that are indicators of failure degrees in the image forming apparatus by assigning the internal information acquired by the acquiring portion or the value obtained from the internal information to the selected logistic regression model.

2. The failure prevention diagnosis support system as claimed in claim 1, wherein:

the risk degrees include an image-quality degradation risk that is an indicator of a degree of failure that causes image quality degradation, and a paper-feed trouble risk that is an indicator of a degree of failure that causes a paper jam; and the logistic regression models stored in the storage portion include an image-quality logistic regression model for calculating the image-quality degradation risk, and a paper-feed logistic regression model for calculating the paper-feed trouble risk.

3. The failure prevention diagnosis support system as claimed in claim 2, wherein:

the internal information contains at least one of the number of system failures that is a number of operation errors caused in the image forming apparatus, a number of image-quality local failures that is a number of times an image-quality sensor for detecting information about image quality of the image forming apparatus outputs a value that is beyond a predetermined range, a measurement value of the image-quality sensor, an average number of paper sheets fed between a time when an operation error occurs and a time when the next operation error occurs, and an image-quality critical rate that is determined by dividing a largest possible number of uses of expendable items affecting the image quality by the number of uses at present; and the explanatory variable of the image-quality logistic regression model is the internal information.

4. The failure prevention diagnosis support system as claimed in claim 2, wherein:

the internal information contains at least one of a number of paper jams, a number of document paper jams, an average number of paper sheets fed between a time when a paper jam occurs and a time when the next paper jam occurs, a number of paper-feed local failures that is a number of times a paper sensor for detecting information about paper sheets of the image forming apparatus outputs a value that is beyond a predetermined range, a total number of fed paper sheets, and a paper-feed critical rate that is determined by dividing a largest possible number of uses of expendable items used for feeding the paper sheets by the number of uses at present; and the explanatory variable of the paper-feed logistic regression model is the internal information.

5. The failure prevention diagnosis support system as claimed in claim 1, wherein:

the internal information contains jam failure information that is information about operation errors as paper jams, and non-jam failure information that is information about operation errors other than paper jam;

the jam failure information contains a number of component jam failures that is a number of paper jams caused in each component of the image forming apparatus, and a number of jam-triggering errors that is a number of errors that are related to causes of operation errors as paper jams and are caused in components of the image forming apparatus;

the non-jam failure information contains a number of non-jam-triggering errors that is a number of errors that are related to causes of operation errors other than paper jams and are caused in the components of the image forming apparatus;

the explanatory variables of the one or the plurality of logistic regression models are values obtained from the internal information; and the values obtained from the internal information include the sum of the non-jam failure information as the internal information and the sum of the jam failure information as the internal information.

6. The failure prevention diagnosis support system as claimed in claim 5, wherein:

the explanatory variables of the one or the plurality of logistic regression models are values obtained from the internal information; and the values obtained from the internal information include a weighted sum of the non-j am failure information as the internal information and a weighted sum of the jam failure information as the internal information.

7. The failure prevention diagnosis support system as claimed in claim 1, wherein:

the internal information contains time-course information that is information about a time course of the image forming apparatus between a repair time and a support time; and the explanatory variables of the one or the plurality of logistic regression models include the time-course information.

8. The failure prevention diagnosis support system as claimed in claim 7, wherein the time-course information contains a number of formed images that is a number of times the image forming apparatus forms an image between the repair time and the support time.

9. The failure prevention diagnosis support system as claimed in claim 7, wherein the time-course information contains a time elapsed between the repair time and the support time of the image forming apparatus.

10. The failure prevention diagnosis support system as claimed in claim 1, wherein:

the storage portion stores the internal information acquired by the acquiring portion and acquirement time information indicating the time at which the internal information is acquired, the internal information and the acquirement time information being associated with each other by the controller; and the controller performs a control operation so as to update the one or the plurality of logistic regression models stored in the storage portion, based on the internal information that is stored in the storage portion and is associated with a time immediately before a repair time for the image forming apparatus, and the internal information that is stored in the storage portion and is associated with a time immediately after the repair time.

11. The failure prevention diagnosis support system as claimed in claim 1, wherein:

the acquiring portion acquires image forming apparatus identification information for identifying the image forming apparatus, and the internal information about the image forming apparatus identified by the image forming apparatus identification information, the image forming apparatus identification information and the internal information being associated with each other;

the storage portion stores the image forming apparatus identification information and the internal information acquired and associated with each other by the acquiring portion, and placement area identification information for identifying the area in which the image forming apparatus identified by the image forming apparatus identification information is placed, the image forming apparatus identification information and the placement area identification information being associated with each other by the controller; and the controller performs a control operation so as to update the one or the plurality of logistic regression models stored in the storage portion, based on the internal information that is associated with the image forming apparatus identification information about one or a plurality of image forming apparatuses identified by the same placement area identification information stored in the storage portion.

12. The failure prevention diagnosis support system as claimed in claim 11, further comprising a display that displays the risk degrees calculated under the control of the controller, wherein the controller performs a control operation so that the display displays a chronological chart that is created by associating the calculated risk degrees with acquirement time information stored in the storage portion and associated with the internal information used for calculating the risk degrees.

13. The failure prevention diagnosis support system as claimed in claim 12, further comprising an input portion that inputs service engineer identification information for identifying a person in charge of maintenance of the image forming apparatus, wherein:

the storage portion stores the image forming apparatus identification information and the service engineer identification information about the image forming apparatus identified by the image forming apparatus identification information, with the image forming apparatus identification information and the service engineer identification information being associated with each other by the controller; and the controller obtains the image forming apparatus identification information stored in the storage portion and associated with the service engineer identification information input by the input portion, obtains the internal information stored in the storage portion and associated with the obtained image forming apparatus identification information, performs a control operation so as to calculate the risk degrees with the use of the internal information obtained based on all the obtained image forming apparatus identification information, and controls the display to collectively display the calculated risk degrees arid the image forming apparatus identification information, with the risk degrees and the image forming apparatus identification information being associated with one another.

14. The failure prevention diagnosis support system as claimed in claim 13, wherein:

the input portion inputs the placement area identification information; and the controller obtains the placement area identification information that is input by the input portion, obtains the internal information and the image forming apparatus identification information stored in the storage portion and associated with the obtained placement area identification information, performs a control operation so as to calculate the risk degrees with the use of the internal information obtained based on all the obtained image forming apparatus identification information, and controls the display to collectively display the calculated risk degrees and the image forming apparatus identification information, with the risk degrees and the image forming apparatus identification information being associated with one another.

15. The failure prevention diagnosis support system as claimed in claim 13, further comprising a terminal device that includes at least one display controlled by the controller, via a network and the input portion.

16. The failure prevention diagnosis support system as claimed in claim 11, further comprising a failure diagnosis portion that detects a failure in components or sets of components forming the image forming apparatus by analyzing a failure diagnosis model that has model causes of failures in the image forming apparatus, wherein:

the input portion inputs the image forming apparatus identification information; and the controller obtains the internal information stored in the storage portion and associated with the image forming apparatus identification information that is input by the input portion, controls the failure diagnosis portion to calculate probabilities of failures in the components or the sets of components that are causes of failures in the image forming apparatus identified by the image forming apparatus identification information, with the failure diagnosis portion being controlled on the basis of the obtained internal information, and controls the display to display the failure cause occurrence probabilities calculated by the failure diagnosis portion and the components or the sets of components that are sites of the causes of failures, with the failure cause occurrence probabilities and the components or the sets of components being associated with one another.

17. The failure prevention diagnosis support system as claimed in claim 1, wherein the acquiring portion acquires the internal information about the image forming apparatus via a network.

18. A failure prevention diagnosis support method comprising:

acquiring internal information about an internal state of an image forming apparatus;

storing one or a plurality of logistic regression models that define an estimate value of a regression coefficient through a logistic regression analysis using the internal information obtained when the image forming apparatus is in a failed state and in a normal state, the one or the plurality of logistic regression models having an objective variable that is a binary variable representing one of a failed state and a normal state of the image forming apparatus, the one or the plurality of logistic regression models having an explanatory variable that is the internal information about the image forming apparatus or a value obtained from the internal information; and performing a control operation so as to select a logistic regression model from the one or the plurality of the logistic regression models stored in a storage portion in accordance with the image forming apparatus, and to calculate risk degrees as objective variables that are indicators of failure degrees in the image forming apparatus by assigning the internal information acquired in the acquiring step or the value obtained from the internal information to the selected logistic regression model.

19. A computer readable medium storing a program causing a computer to execute a process for failure prevention diagnosis support, the process comprising:

acquiring internal information about an internal state of an image forming apparatus;

storing one or a plurality of logistic regression models that define an estimate value of a regression coefficient through a logistic regression analysis using the internal information obtained when the image forming apparatus is in a failed state and in a normal state, the one or the plurality of logistic regression models having an objective variable that is a binary variable representing one of a failed state and a normal state of the image forming apparatus, the one or the plurality of logistic regression models having an explanatory variable that is the internal information about the image forming apparatus or a value obtained from the internal information; and performing a control operation so as to select a logistic regression model from the one or the plurality of the logistic regression models stored in a storage portion in accordance with the image forming apparatus, and to calculate risk degrees as objective variables that are indicators of failure degrees in the image forming apparatus by assigning the internal information acquired in the acquiring step or the value obtained from the internal information to the selected logistic regression model.

* * * * *